US012674298B2

(12) United States Patent
Hirate

(10) Patent No.: US 12,674,298 B2
(45) Date of Patent: Jul. 7, 2026

(54) SHOVEL

(71) Applicant: SUMITOMO HEAVY INDUSTRIES, LTD., Tokyo (JP)

(72) Inventor: Shoji Hirate, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 154 days.

(21) Appl. No.: 18/396,034

(22) Filed: Dec. 26, 2023

(65) Prior Publication Data

US 2024/0209590 A1 Jun. 27, 2024

(30) Foreign Application Priority Data

Dec. 27, 2022 (JP) ..... 2022-210779

(51) Int. Cl.

| | |
|---|---|
| ***E02F 3/43*** | (2006.01) |
| ***E02F 3/42*** | (2006.01) |
| ***E02F 9/20*** | (2006.01) |
| ***E02F 9/22*** | (2006.01) |

(52) U.S. Cl.

CPC ..... *E02F 3/431* (2013.01); *E02F 3/422* (2013.01); *E02F 9/205* (2013.01); *E02F 9/2207* (2013.01); *E02F 9/2228* (2013.01); *E02F 9/2271* (2013.01)

(58) Field of Classification Search

CPC . E02F 3/431; E02F 3/422; E02F 9/205; E02F 9/2207; E02F 9/2228; E02F 9/2271

See application file for complete search history.

(56) References Cited

U.S. PATENT DOCUMENTS

| | | | | | |
|---|---|---|---|---|---|
| 5,832,730 | A * | 11/1998 | Mizui | E02F 9/2207 91/361 |
| 2004/0060205 | A1 | 4/2004 | Yoshino | |
| 2020/0115882 | A1* | 4/2020 | Sano | E02F 9/2267 |
| 2020/0240114 | A1 | 7/2020 | Yamamoto | |
| 2020/0407945 | A1* | 12/2020 | Okada | F15B 11/003 |

FOREIGN PATENT DOCUMENTS

| | | | | |
|---|---|---|---|---|
| EP | 0747797 | | 8/2000 | |
| JP | S63-7426 | | 1/1988 | |
| JP | H05-163746 | | 6/1993 | |
| JP | H05-321297 | | 12/1993 | |
| JP | H05321297 | A * | 12/1993 | E02F 9/2207 |
| JP | H09-328785 | | 12/1997 | |
| JP | 2003-65301 | | 3/2003 | |
| JP | 2014-222007 | | 11/2014 | |
| JP | 2021-188432 | | 12/2021 | |
| WO | 2019/078077 | | 4/2019 | |

* cited by examiner

*Primary Examiner* — Kito R Robinson
*Assistant Examiner* — Erin Marie Hartmann
(74) *Attorney, Agent, or Firm* — IPUSA, PLLC

(57) ABSTRACT

A shovel includes a lower traveling body, an upper swing body swingably mounted on the lower traveling body, an attachment attached to the upper swing body, a hydraulic cylinder configured to drive the attachment, and processing circuitry configured to control, in accordance with a state of acceleration of the hydraulic cylinder, movement of the hydraulic cylinder to suppress vibration of the hydraulic cylinder caused by an operation input related to the hydraulic cylinder.

10 Claims, 11 Drawing Sheets

SHOVEL

CROSS-REFERENCE TO RELATED APPLICATIONS

This application is based upon and claims priority to Japanese Patent Application No. 2022-210779, filed on Dec. 27, 2022, the entire contents of which are incorporated herein by reference.

BACKGROUND

Technical Field

The present disclosure relates to a shovel.

Description of Related Art

A shovel provided with an attachment driven by a hydraulic cylinder is known.

SUMMARY

According to an embodiment of the present disclosure, a shovel includes a lower traveling body, an upper swing body swingably mounted on the lower traveling body, an attachment attached to the upper swing body, a hydraulic cylinder configured to drive the attachment, and processing circuitry configured to control, in accordance with a state of acceleration of the hydraulic cylinder, movement of the hydraulic cylinder to suppress vibration of the hydraulic cylinder caused by an operation input related to the hydraulic cylinder.

DETAILED DESCRIPTION

Depending on the contents of the operation related to the hydraulic cylinder, vibration of the hydraulic cylinder may occur due to the spring of the oil column. For example, in a case where the boom raising operation is performed at a relatively high speed, vibration may occur in the hydraulic cylinder during acceleration from a stopped state, or during deceleration or stopping from a relatively high speed. Therefore, for example, vibration generated to the attachment due to the vibration of the hydraulic cylinder may cause the quality of the work using the attachment to be degraded. Further, for example, the vibration transmitted from the attachment to the vehicle body due to the vibration of the hydraulic cylinder may cause the operator in the cabin of the vehicle to feel uncomfortable.

According to an embodiment, a technique capable of suppressing vibration of a hydraulic cylinder caused by an operation input, the hydraulic cylinder driving an attachment of a shovel, is provided.

According to an embodiment, it is possible to suppress vibration of a hydraulic cylinder caused by an operation input, the hydraulic cylinder driving an attachment of a shovel.

Hereinafter, an embodiment will be described with reference to the drawings.

[Overview of Shovel]

An overview of a shovel 100 according to an embodiment will be described with reference to FIG. 1 to FIG. 3.

Figure 1:
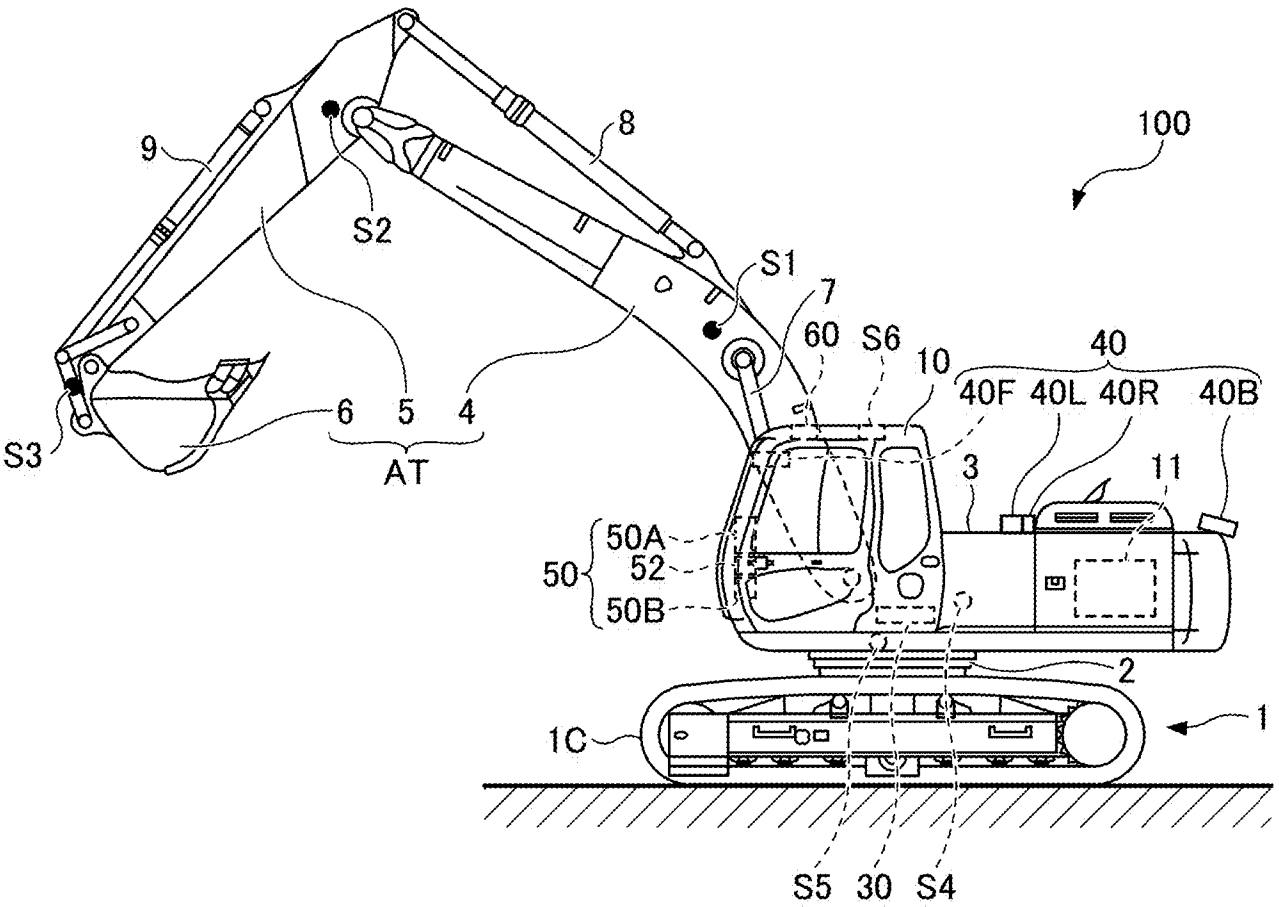
FIG. 1 is a side view illustrating an example of a shovel.

FIG. 1 is a side view illustrating an example of the shovel 200. FIG. 2 is a top view illustrating an example of the shovel 100. FIG. 3 is a diagram illustrating an example of a configuration related to remote control of the shovel 100. Hereinafter, a direction with respect to the shovel 100 or a direction viewed from the shovel 100 may be described by defining a direction in which an attachment AT extends in the top view of the shovel 100 (an upward direction in FIG. 2) as "front".

Figure 2:
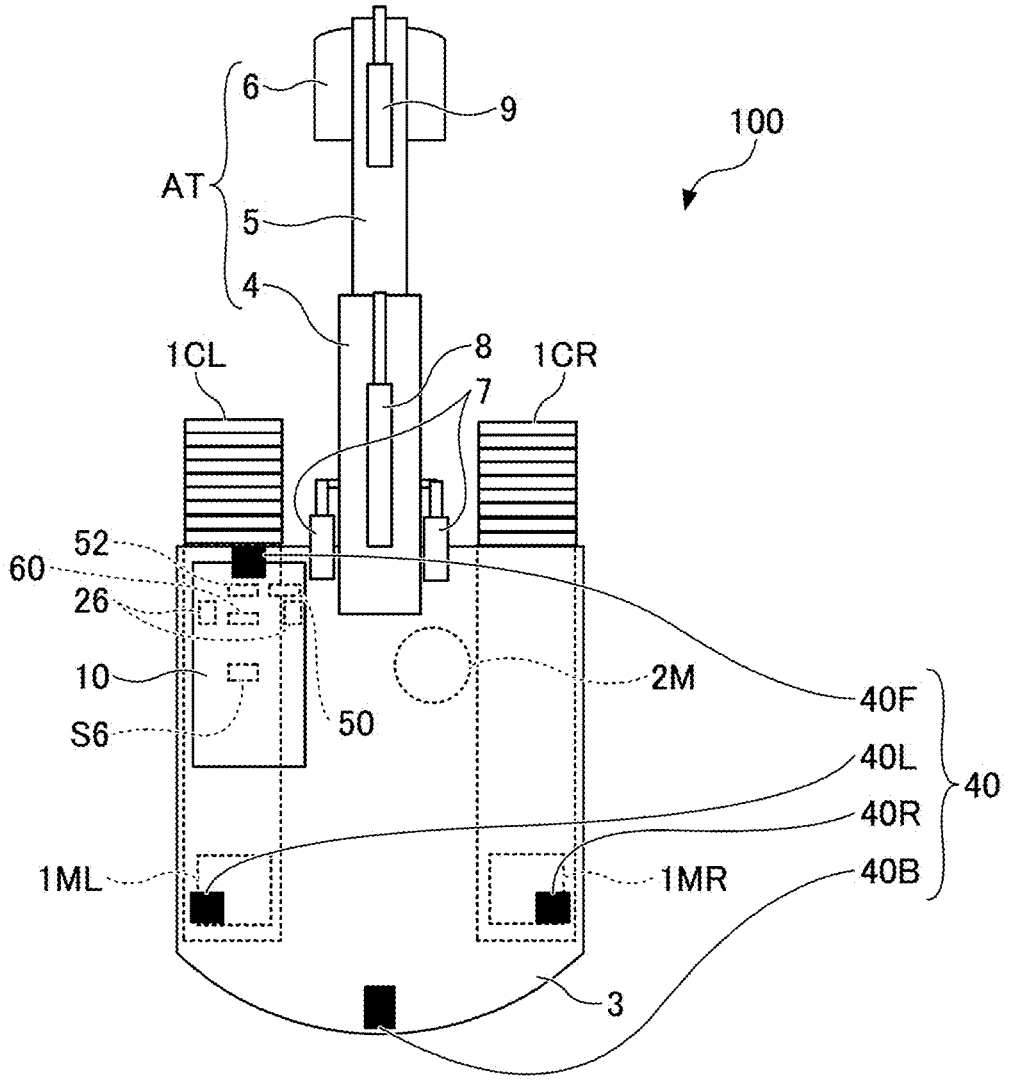
FIG. 2 is a top view illustrating an example of the shovel.

As illustrated in FIG. 1 and FIG. 2, the shovel 100 includes a lower traveling body 1, an upper swing body 3, the attachment AT including a boom 4, an arm 5, and a bucket 6, and a cabin 10.

The lower traveling body 1 causes the shovel 100 to travel by using a crawler 1C. The crawler 1C includes a left crawler 1CL and a right crawler 1CR. The crawler 1CL is hydraulically driven by a traveling hydraulic motor 1ML. Similarly, the crawler 1CR is hydraulically driven by a traveling hydraulic motor 1MR. Thus, the lower traveling body 1 can travel by itself.

The upper swing body 3 is swingably mounted on the lower traveling body 1 via a swing mechanism 2. For example, the upper swing body 3 swings with respect to the lower traveling body 1 by the swing mechanism 2 being hydraulically driven by a swing hydraulic motor 2M.

The boom 4 is attached to the center of the front portion of the upper swing body 3 to be able to move vertically about a rotation axis that is the left-right direction. The arm 5 is attached to the distal end of the boom 4 to be able to rotate about the rotation axis that is the left-right direction. The bucket 6 is attached to the distal end of the arm 5 to be able to rotate about the rotation axis that is the left-right direction.

The bucket 6 is an example of an end attachment, and is used for, for example, excavation work, slope finishing work, and leveling work.

The bucket 6 is attached to the distal end of the arm 5 in a manner that the bucket 6 can be appropriately replaced according to the work contents of the shovel 100. That is, instead of the bucket 6, a bucket of a type different from the bucket 6, for example, a relatively large bucket, a slope finishing bucket, a dredging bucket, or the like may be attached to the distal end of the arm 5. An end attachment of a type other than the bucket, for example, an agitator, a breaker, a crusher, or the like may be attached to the distal end of the arm 5. Furthermore, for example, an auxiliary attachment such as a quick coupler or a tilt rotator may be provided between the arm 5 and the end attachment.

The boom 4, the arm 5, and the bucket 6 are hydraulically driven by a boom cylinder 7, an arm cylinder 8, and a bucket cylinder 9, respectively.

The cabin 10 is an operation room in which an operator rides and operates the shovel 100. The cabin 10 is mounted on, for example, the left side of the front portion of the upper swing body 3.

For example, the shovel 100 causes driven elements such as the lower traveling body 1 (that is, the pair of left and right crawlers 1CL and 1CR), the upper swing body 3, the boom 4, the arm 5, and the bucket 6 to move in response to an operation of the operator in the cabin 10.

The shovel 100 may be configured to be remotely operated from the outside of the shovel 100 instead of or in addition to being configured to be operable by the operator in the cabin 10. In a case where the shovel 100 is remotely operated, the inside of the cabin 10 may be unmanned. In a case where the shovel 100 is dedicated to remote control, the cabin 10 may be omitted.

Hereinafter, the description will be given on the assumption that the operation of the operator includes at least one of the operation of the operator in the cabin 10 on an operation device 26 and the remote operation of the operator outside the shovel 100.

Figure 3:
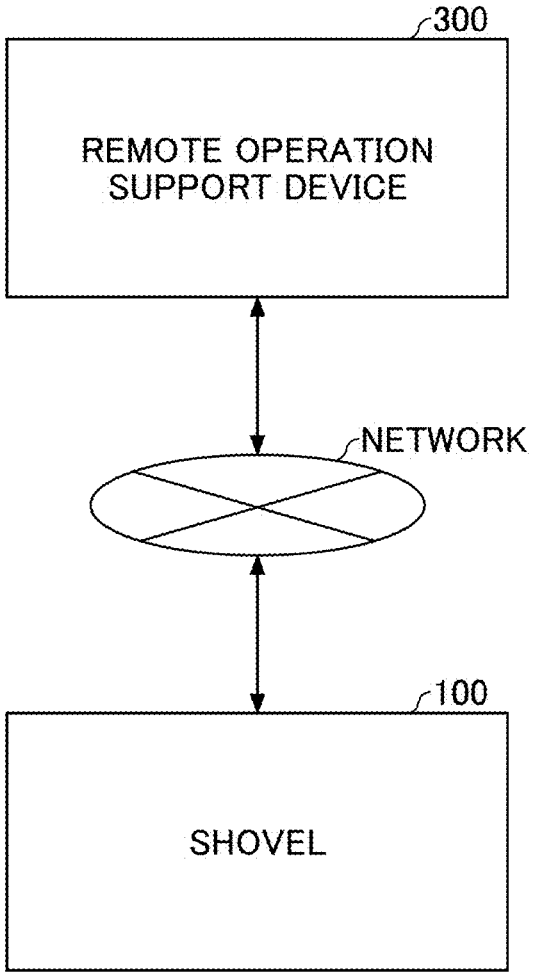
FIG. 3 is a diagram illustrating a configuration example related to remote control of the shovel.

For example, as illustrated in FIG. 3, the remote operation includes a mode in which the shovel 100 is operated by an operation input related to an actuator of the shovel 100 performed by a remote operation support device 300 capable of communicating with the shovel 100 via a communication line NW. In such a case, the shovel 100 is equipped with a communication device 60, and can communicate with the remote operation support device 300 via the predetermined communication line NW.

The communication line NW includes, for example, a local area network (LAN) at a work site. The communication line NW may also include a wide area network (WAN). The wide area network includes, for example, a mobile communication network whose terminals are base stations, a satellite communication network using communication satellites, and an Internet network. The communication line NW may also include a short distance communication line based on wireless communication standards such as WiFi or Bluetooth (registered trademark).

The remote operation support device 300 is provided in, for example, a management center that manages the work of the shovel 100 from the outside. The remote operation support device 300 may be a portable operation terminal. In such a case, the operator can remotely operate the shovel 100 while directly checking the work situation of the shovel 100 from the periphery of the shovel 100.

The shovel 100 may transmit an image (hereinafter, referred to as a "surrounding image") showing the state of the surrounding including the front of the shovel 100 based on a captured image output by an imaging device 40 mounted on the shovel to the remote operation support device 300 through the communication device 60 mounted on the shovel, for example. The shovel 100 may also transmit the captured image output by the imaging device 40 to the remote operation support device 300 through the communication device 60, and the remote operation support device 300 may process the image received from the shovel 100 to generate an image of the surrounding. The remote operation support device 300 may then display the surrounding image showing the surrounding situation including the front of the shovel 100 on a display device of the remote operation support device. Furthermore, various information images (information screen) to be displayed on an output device 50 (display device) inside the cabin 10 of the shovel 100 may be displayed on the remote operation support device 300 (display part) in the same manner. Thus, the operator who uses the remote operation support device 300 can remotely operate the shovel 100 while checking the contents displayed such as the image or information screen showing the state around the shovel 100. The shovel 100 may cause the actuator to operate in response to a remote operation signal indicating the contents of the remote operation received from the remote operation support device 300 through the communication device 60 to drive the driven elements such as the lower traveling body 1, the upper swing body 3, the boom 4, the arm 5, and the bucket 6.

The remote operation may include a mode in which the shovel 100 is operated by a voice input, a gesture input, or the like to the shovel 100 from a parson (for example, a worker) around the shovel 100. Specifically, the shovel 100 recognizes a voice uttered by a nearby worker or the like, a gesture performed by the worker or the like, or the like through a sound input device (for example, a microphone), a gesture input device (for example, an imaging device), or the like mounted on the shovel 100, respectively. The shovel 100 may cause the actuator to move in accordance with the contents of the recognized voice, gesture, or the like to drive the driven elements such as the lower traveling body 1 (the right and left crawler 1C), the upper swing body 3, the boom 4, the arm 5, and the bucket 6.

The shovel 100 may cause the actuator to move automatically regardless of the contents of the operator's operation. Accordingly, the shovel 100 can provide a function to cause at least some of the driven elements such as the lower traveling body 1, the upper swing body 3, and the attachment AT to move automatically. That is, what is known as "automatic operation function" can be achieved by the shovel. The automatic operation function is also referred to as a "machine control (MC) function".

The automatic operation function includes, for example, a semi-automatic operation function. The semi-automatic operation function is also referred to as an operation-assisted MC function. The semi-automatic operation function is a function of automatically causing, in conjunction with a driven element (actuator) to be operated, another driven element (actuator) to move in response to an operation of the operator. The automatic operation function may also include a fully automatic operation function. The fully automatic operation function is also referred to as a fully automatic MC function. The fully automatic operation function is a function of automatically causing at least some of driven elements (hydraulic actuators) to move on the premise that there is no operation by the operator. In a case where the fully automatic operation function is enabled in the shovel 100, the inside of the cabin 10 may be in an unmanned state. In a case where the shovel 100 is exclusively operated by the fully automatic operation function, the cabin 10 may be omitted. The semi-automatic operation function, the fully automatic operation function, and the like include, for example, a rule-based automatic operation function. The rule-based automatic operation function is an automatic operation function in which the contents of movement for a driven element (actuator) to be automatically driven are automatically determined according to a rule defined in advance. The semi-automatic operation function, the fully automatic operation function, and the like may also include an autonomous operating function. The autonomous operating function is an automatic operation function in which the shovel 100 autonomously makes various determinations and the contents of movement for a driven element (hydraulic actuator) to be automatically driven are determined based on the determination result.

The work of the shovel 100 may be remotely monitored. In such a case, for example, a remote monitoring support device having the same function as the remote operation support device 300 is provided. A monitoring person who is a user of the remote monitoring support device can monitor the situation of the work of the shovel 100 while checking the surrounding image displayed on the remote monitoring support device (display part). For example, when the monitoring person determines that the monitoring is necessary from the viewpoint of safety, the monitoring person can perform a predetermined input with the remote monitoring support device (input part) to intervene in the operation by the operator or the automatic operation of the shovel 100 to urgently stop the shovel 100.

[Hardware Configuration of Shovel]

Next, a hardware configuration of the shovel 100 will be described with reference to FIG. 4 in addition to FIG. 1 to FIG. 3.

Figure 4:
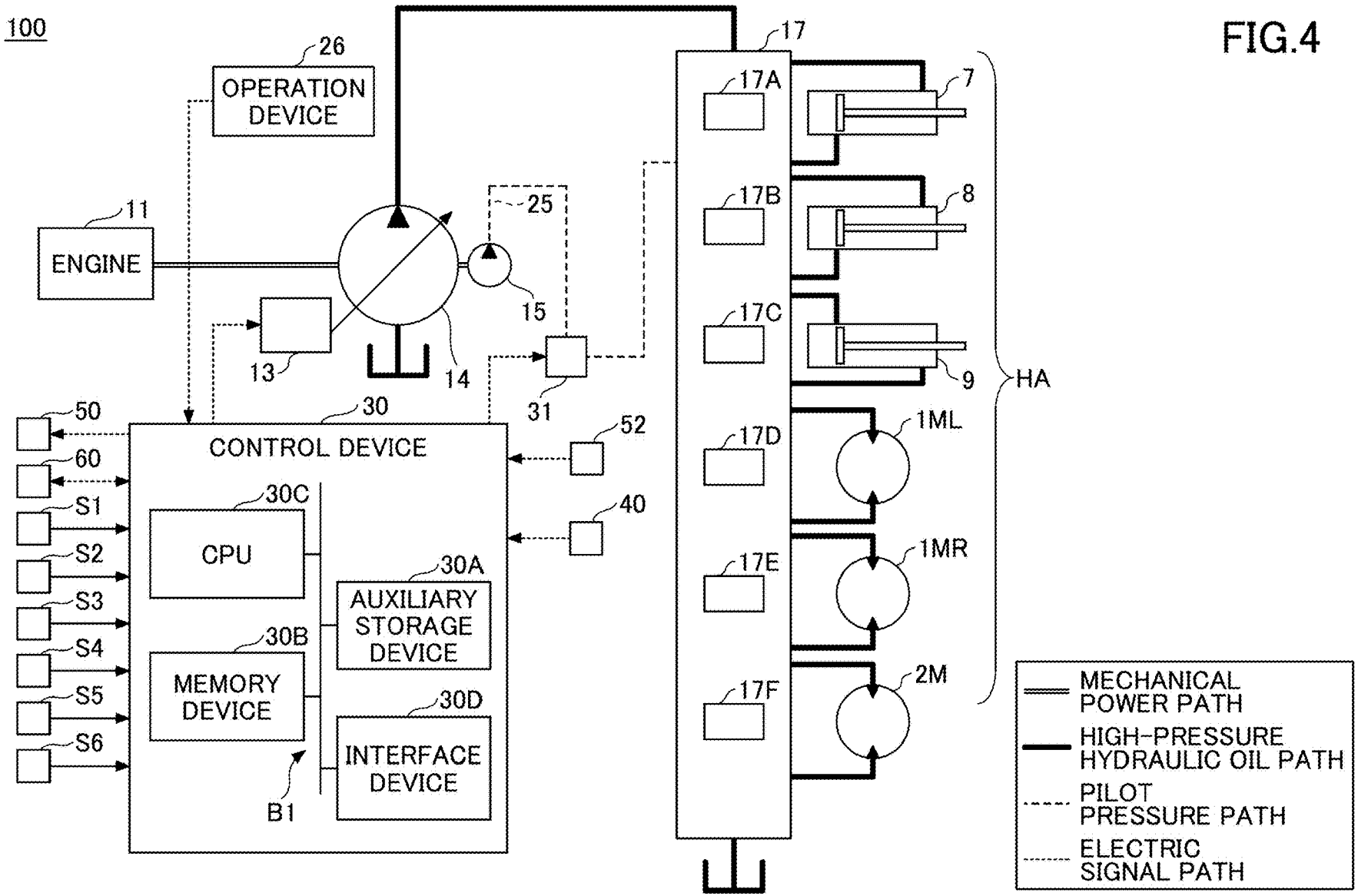
FIG. 4 is a diagram illustrating an example of a hardware configuration of the shovel.

FIG. 4 is a block diagram illustrating an example of a hardware configuration of the shovel 100.

In FIG. 4, a path through which mechanical power is transmitted is indicated by a double line, a path through which high-pressure hydraulic oil for driving the hydraulic actuator flows is indicated by a solid line, a path through which pilot pressure is transmitted is indicated by a broken line, and a path through which an electric signal is transmitted is indicated by a dotted line.

The shovel 100 includes respective components such as a hydraulic drive system related to hydraulic drive of a driven element, an operation system related to operation of the driven element, a user interface system related to exchange of information with a user, a communication system related to communication with the outside, and a control system related to various controls.

<Hydraulic Drive System>

As illustrated in FIG. 4, the hydraulic drive system of the shovel 100 includes a hydraulic actuator HA that hydraulically drives the driven elements such as the lower traveling body 1 (the right and left crawler 1C), the upper swing body 3, the boom 4, the arm 5, and the bucket 6, as described above. The hydraulic drive system of the shovel 100 according to this embodiment also includes the engine 11, a regulator 13, a main pump 14, and a control valve 17.

The hydraulic actuator HA includes the traveling hydraulic motors 1ML and 1MR, the swing hydraulic motor 2M, the boom cylinder 7, the arm cylinder 8, the bucket cylinder 9, and the like.

Note that, some or all of the components included in the hydraulic actuator HA may be replaced with electric actuators in the shovel 100. That is, the shovel 100 may be a hybrid shovel or an electric shovel.

The engine 11 is a motor of the shovel 100 and is a main power source in the hydraulic drive system. The engine 11 is, for example, a diesel engine fueled with diesel fuel. The engine 11 is mounted on, for example, the rear portion of the upper swing body 3. The engine 11 constantly rotates at a predetermined target speed set in advance under direct or indirect control of a controller 30 (an example of processing circuitry) described later to drive the main pump 14 and a pilot pump 15, for example.

Note that, instead of or in addition to the engine 11, another motor (for example, an electric motor) or the like may be mounted on the shovel 100.

The regulator 13 controls (adjusts) the discharge amount of the main pump 14 under the control of the controller 30. For example, the regulator 13 adjusts the angle of the swash plate of the main pump 14 (hereinafter, referred to as "tilt angle") in response to a control command from the controller 30.

The main pump 14 supplies the hydraulic oil to the control valve 17 via a high-pressure hydraulic line. The main pump 14 is mounted, for example, on the rear portion of the upper swing body 3 in the same manner as the engine 11. The main pump 14 is driven by the engine 11 as described above. The main pump 14 is, for example, a variable displacement hydraulic pump, and as described above, the regulator 13 adjusts the tilt angle of the swash plate, thereby adjusting the stroke length of the piston and controlling the discharge flow rate and the discharge pressure, under the control of the controller 30.

The control valve 17 causes the hydraulic actuator HA to operate in accordance with the contents of the operation or remote operation on the operation device 26 by the operator or an operation command corresponding to the automatic operation function. The control valve 17 is mounted, for example, in the central portion of the upper swing body 3. As described above, the control valve 17 is connected to the main pump 14 via the high-pressure hydraulic line, and selectively supplies the hydraulic oil supplied from the main pump 14 to each hydraulic actuator in response to an operation of the operator or an operation command corresponding to the automatic operation function. The control valve 17 includes direction switching valves 17A to 17F that control the flow rate and the flow direction of the hydraulic oil supplied from the main pump 14 to each of the components included in the hydraulic actuator HA.

The direction switching valve 17A controls the flow rate and the flow direction of the hydraulic oil supplied to the boom cylinder 7. Thus, the direction switching valve 17A can extend and contract the boom cylinder 7 at a variable speed. The direction switching valve 17A is, for example, a spool valve.

The direction switching valve 17B controls the flow rate and the flow direction of the hydraulic oil supplied to the arm cylinder 8. Thus, the direction switching valve 17B can extend and contract the arm cylinder 8 at a variable speed. The direction switching valve 17B is, for example, a spool valve.

The direction switching valve 17C controls the flow rate and the flow direction of the hydraulic oil supplied to the bucket cylinder 9. Thus, the direction switching valve 17C can expand and contract the bucket cylinder 9 at a variable speed. The direction switching valve 17C is, for example, a spool valve.

The direction switching valve 17D controls the flow rate and the flow direction of the hydraulic oil supplied to the traveling hydraulic motor 1ML. Thus, the direction switching valve 17D can rotate the traveling hydraulic motor 1ML in both directions at a variable speed. The direction switching valve 17D is, for example, a spool valve.

The direction switching valve 17E controls the flow rate and the flow direction of the hydraulic oil supplied to the traveling hydraulic motor 1MR. Thus, the direction switching valve 17E can rotate the traveling hydraulic motor 1MR in both directions at a variable speed. The direction switching valve 17E is, for example, a spool valve.

The direction switching valve 17F controls the flow rate and the flow direction of the hydraulic oil supplied to the swing hydraulic motor 2M. Thus, the direction switching valve 17F can rotate the swing hydraulic motor 2M in both directions at a variable speed. The direction switching valve 17F is, for example, a spool valve.

<Operation System>

As illustrated in FIG. 4, the operation system of the shovel 100 includes the pilot pump 15, the operation device 26, and a hydraulic control valve 31.

The pilot pump 15 supplies a pilot pressure to various hydraulic devices via a pilot line 25. The pilot pump 15 is mounted, for example, on the rear portion of the upper swing body 3 in the same manner as the engine 11. The pilot pump 15 is, for example, a fixed displacement hydraulic pump, and is driven by the engine 11 as described above.

Note that, the pilot pump 15 may be omitted. In such a case, a relatively low-pressure hydraulic oil obtained by reducing the pressure of a relatively-high pressure hydraulic oil discharged from the main pump 14 by a predetermined pressure reducing valve may be supplied to various hydraulic devices as a pilot pressure.

The operation device 26 is provided near the operator's seat in the cabin 10 and is used by the operator to operate the various driven elements. Specifically, the operation device 26 is used by the operator to operate the hydraulic actuator HA that drives each driven element, and as a result, the operation by the operator with respect to the driven element to be driven by the hydraulic actuator HA can be achieved. The operation device 26 includes a pedal device and a lever device (for example, lever devices 26A to 26C described later) for operating the respective driven elements (hydraulic actuator HA).

For example, as illustrated in FIG. 4, the operation device 26 is of an electric type.

Specifically, the operation device 26 outputs an electric signal (hereinafter, referred to as an "operation signal") corresponding to the operation contents, and the operation signal is received by the controller 30. The controller 30 outputs an operation command corresponding to the content of the operation signal, that is, an operation command (control signal) corresponding to the operation contents with respect to the operation device 26 to the hydraulic control valve 31. Accordingly, the pilot pressure corresponding to the operation contents performed on the operation device 26 is input from the hydraulic control valve 31 to the control valve 17, and the control valve 17 can drive each of the components included in the hydraulic actuator HA according to the operation contents performed on the operation device 26.

Furthermore, the direction switching valves 17A to 17F that are built in the control valve 17 and drive the respective components included in the hydraulic actuator HA may be electromagnetic solenoid valves. In such a case, an operation signal output from the operation device 26 may be directly input to the control valve 17 (that is, to the direction switching valves of the electromagnetic solenoid type).

Note that, the operation device 26 may be of a hydraulic pilot type. Specifically, the operation device 26 outputs a pilot pressure corresponding to the operation contents to a pilot line on the secondary side by using the hydraulic oil supplied from the pilot pump 15 via a pilot line. The pilot line on the secondary side is connected to the control valve 17. Thus, the pilot pressure corresponding to the operation contents related to the various driven elements (hydraulic actuator HA) in the operation device 26 can be input to the control valve 17. Thereby, the control valve 17 can drive each component included in the hydraulic actuator HA in accordance with the operation contents performed on the operation device 26 by the operator or the like. In such a case, an operation state sensor capable of acquiring information on the operation state of the operation device 26 is provided, and output of the operation state sensor is transmitted to the controller 30. Thus, the controller 30 can ascertain the operation state of the operation device 26. The operation state sensor is, for example, a pressure sensor that acquires information on a pilot pressure (operation pressure) of a pilot line on the secondary side of the operation device 26.

As described above, some or all of the components included in the hydraulic actuator HA may be replaced with electric actuators. In such a case, for example, the controller 30 may output an operation command corresponding to the operation contents performed on the operation device 26 or the contents of the remote operation defined by the remote operation signal to the electric actuator, a driver that drives the electric actuator, or the like. Furthermore, the electric actuator may be configured to be operable by inputting an operation signal from the operation device 26 to the electric actuator, the driver, or the like.

In a case where the shovel 100 is exclusively remotely operated or in a case where the shovel 100 is exclusively operated by the fully automatic operation function, the operation device 26 may be omitted.

The hydraulic control valve 31 is provided for each driven element (hydraulic actuator HA) to be operated by the operation device 26 and for each movement direction (for example, the raising direction and the lowering direction of the boom 4) of the respective driven elements (hydraulic actuator HA). For example, two hydraulic control valves 31 are provided for each component included in the double-acting type hydraulic actuator HA for driving the lower traveling body 1, the upper swing body 3, the boom 4, the arm 5, the bucket 6, and the like. The hydraulic control valve 31 may be provided, for example, in a pilot line between the pilot pump 15 and the control valve 17, and may be configured to be able to change the flow passage area (that is, the cross-sectional area through which the hydraulic oil can flow) thereof. Thus, the hydraulic control valve 31 can output a predetermined pilot pressure to the pilot line on the secondary side by using the hydraulic oil of the pilot pump 15 supplied through a pilot line on the primary side. Accordingly, a predetermined pilot pressure corresponding to an operation command from the controller 30 can be applied to the control valve 17 through the hydraulic control valve 31. That is, for example, the controller 30 can supply a pilot pressure according to the operation contents (operation signal) performed on the operation device 26 to the control valve 17 directly through the hydraulic control valve 31, and the movement of the shovel 100 based on the operation of the operator can be achieved.

The controller 30 may also control the hydraulic control valve 31 to achieve the automatic operation function of the shovel 100. Specifically, the controller 30 outputs an operation command corresponding to the automatic operation function to the hydraulic control valve 31, thereby achieving the movement of the shovel 100 by the automatic operation function.

The controller 30 may control the hydraulic control valve 31 to achieve remote control of the shovel 100. Specifically, the controller 30 outputs an operation command corresponding to the contents of the remote operation designated by the remote operation signal received from the remote operation support device 300 to the hydraulic control valve 31 through the communication device 60. Thus, the controller 30 can supply the pilot pressure according to the contents of the remote operation from the hydraulic control valve 31 to the control valve 17, thereby achieving the movement of the shovel 100 based on the remote operation by the operator.

In a case where the operation device 26 is of a hydraulic pilot type, a shuttle valve may be provided in a pilot line between the operation device 26 and the control valve 17 and a pilot line between the hydraulic control valve 31 and the control valve 17. The shuttle valve has two inlet ports and one outlet port, and outputs the hydraulic oil having a higher pilot pressure of the pilot pressures input to the two inlet ports to the outlet port. The shuttle valve is provided for each driven element (hydraulic actuator HA) to be operated by the operation device 26 and for each movement direction of the respective driven elements (hydraulic actuator HA) in the same manner as the hydraulic control valve 31. For example, two shuttle valves are provided for each component included in the double-acting type hydraulic actuator HA for driving the lower traveling body 1, the upper swing body 3, the boom 4, the arm 5, the bucket 6, and the like. One of two inlet ports of the shuttle valve is connected to a pilot line on the secondary side of the operation device 26 (specifically, the above-described lever device or pedal device included in the operation device 26), and the other is connected to a pilot line on the secondary side of the hydraulic control valve 31. The outlet port of the shuttle valve is connected to the pilot port of the corresponding directional control valve of the control valve 17 through a pilot line. The corresponding direction switching valve is a direction switching valve that drives the component of the hydraulic actuator HA to be operated by the above-described lever device or pedal device connected to one inlet port of the shuttle valve. Therefore, each of these shuttle valves can cause the higher one of the pilot pressure of the pilot line on the secondary side of the operation device 26 and the pilot pressure of the pilot line on the secondary side of the hydraulic control valve 31 to act on the pilot port of the corresponding direction switching valve. That is, the controller 30 can control the corresponding direction switching valve by outputting the pilot pressure higher than the pilot pressure on the secondary side of the operation device 26 from the hydraulic control valve 31, without depending on the operation performed on the operation device 26 by the operator. That is, the controller 30 can control the movement of the driven elements (the lower traveling body 1, the upper swing body 3, the boom 4, the arm 5, and the bucket 6) regardless of the operation state of the operator on the operation device 26, and can achieve the automatic operation function and the remote operation function.

In a case where the operation device 26 is of a hydraulic pilot type, in addition to the shuttle valve, a pressure reducing valve may be provided in a pilot line between the operation device 26 and the shuttle valve. The pressure reducing valve is configured to be moved in response to a control signal input from the controller 30, for example, and to be capable of changing the flow passage area thereof. Thus, the controller 30 can forcibly reduce the pilot pressure output from the operation device 26 when the operation device 26 is operated by the operator. Therefore, even when the operation device 26 is operated, the controller 30 can forcibly suppress or stop the movement of the hydraulic actuator HA corresponding to the operation performed on the operation device 26. For example, the controller 30 can, even when the operation device 26 is operated, reduce the pilot pressure output from the operation device 26 by the pressure reducing valve to be lower than the pilot pressure output from the hydraulic control valve 31. The controller 30 can reliably apply a desired pilot pressure to the pilot port of the direction switching valve in the control valve 17, for example, regardless of the operation contents performed on the operation device 26 by controlling the hydraulic control valve 31 and the pressure reducing valve. Accordingly, the controller 30 can more appropriately achieve the automatic operation function and the remote operation function of the shovel 100 by controlling the pressure reducing valve in addition to the hydraulic control valve 31, for example.

<User Interface System>

As illustrated in FIG. 4, the user interface system of the shovel 100 includes the operation device 26, the output device 50, and an input device 52.

The output device 50 outputs various kinds of information for a user of the shovel 100 (for example, an operator in the cabin 10 or an operator who performs an external remote operation), a person around the shovel 100 (for example, a worker or a driver of a work vehicle), or the like.

For example, the output device 50 includes a lighting device, a display device 50A, or the like that outputs various kinds of information in a visual manner. The lighting device is, for example, a warning lamp (indicator lamp) or the like. The display device 50A is, for example, a liquid crystal display, an organic electroluminescence (EL) display, or the like. For example, as illustrated in FIG. 2, the lighting device or the display device 50A may be provided inside the cabin 10, and output various kinds of information to an operator or the like in the cabin 10 in a visual manner.

Furthermore, the lighting device or the display device 50A may be provided on a side surface or the like of the upper swing body 3 and output various kinds of information to a worker around the shovel 100 or the like in a visual manner.

The output device 50 may also include a sound output device 50B that outputs various kinds of information in an auditory manner. The sound output device 50B includes, for example, a buzzer, a speaker, and the like. The sound output device 50B is provided, for example, at least one of in the inside and on the outside of the cabin 10, and outputs various kinds of information to the operator in the cabin 10 and a person (worker or the like) around the shovel 100 in an auditory manner.

The output device 50 may also include a device that outputs various kinds of information in a tactile manner such as vibration to the operator's seat.

The input device 52 receives various input from the user of the shovel 100, and signals corresponding to the received input are transmitted to the controller 30. For example, as illustrated in FIG. 2, the input device 52 is provided inside the cabin 10 and receives an input from an operator in the cabin 10 or the like. The input device 52 may be provided on, for example, a side surface of the upper swing body 3 and may receive an input from a worker around the shovel 100 or the like.

For example, the input device 52 includes an operation input device that receives an input by a mechanical operation from a user. The operation input device may include a touch panel mounted on a display device, a touch pad installed around the display device, a button switch, a lever, a toggle, a knob switch provided in the operation device 26 (lever device), and the like.

The input device 52 may include a sound input device that receives a sound input from a user. The sound input device includes, for example, a microphone.

The input device 52 may also include a gesture input device that receives a gesture input from a user. The gesture input device includes, for example, an imaging device that captures images of a user's gesture.

The input device 52 may also include a biometric input device that receives a biometric input from a user. The biometric input includes, for example, input of biometric information such as a user's fingerprint or iris.

<Communication System>

As illustrated in FIG. 4, the communication system of the shovel 100 according to this embodiment includes the communication device 60.

The communication device 60 is connected to the external communication line NW and communicates with a device provided separately from the shovel 100. The device provided separately from the shovel 100 may include, in addition to the device outside the shovel 100, a portable terminal device (portable terminal) brought into the cabin 10 by a user of the shovel 100. The communication device 60 may include, for example, a mobile communication module conforming to a standard such as 4th Generation (4G) or 5th Generation (5G). The communication device 60 may also include, for example, a satellite communication module. Furthermore, the communication device 60 may include, for example, a WiFi communication module, a Bluetooth (registered trademark) communication module, and the like. In a case where there are multiple connectable communication lines NW, the communication device 60 may include multiple communication devices 60 according to the type of the communication line NW.

For example, the communication device 60 communicates with an external device such as the remote operation support device 300 or the like at a work site through a local communication line constructed at the work site. The local communication line is, for example, a mobile communication line by a local 5G (what is known as local 5G) or a local network by a WiFi6 constructed at a work site.

The communication device 60 may communicate with an external device such as the remote operation support device 300 outside a work site through a communication line of a wide area including the work site, that is, a wide area network.

Note that, when the remote operation, the remote monitoring, or the like of the shovel 100 is not performed, the communication device 60 may be omitted.

<Control System>

As illustrated in FIG. 4, the control system of the shovel 100 includes the controller 30. The control system of the shovel 100 according to this embodiment includes the imaging device 40 and sensors S1 to S6.

The controller 30 performs various controls related to the shovel 100.

The functions of the controller 30 may be implemented by any hardware, or a combination of any hardware and software, or the like. For example, as illustrated in FIG. 4, the controller 30 includes an auxiliary storage device 30A, a memory device 30B, a central processing unit (CPU) 30C, and an interface device 30D, which are connected to each other via a bus B1.

The auxiliary storage device 30A is a non-volatile storage device, and stores a program to be installed, a file and data to be used, and the like. The auxiliary storage device 30A is, for example, an electrically erasable programmable read-only memory (EEPROM), a flash memory, or the like. The memory device 30B loads the program in the auxiliary storage device 30A so that the CPU 30C can read the program, when an instruction to execute the program is given, for example. The memory device 30B is, for example, a static random access memory (SRAM).

The CPU 30C executes, for example, the program loaded onto the memory device 30B, and implements various functions of the controller 30 in accordance with instructions of the program.

The interface device 30D functions as, for example, a communication interface for connecting to a communication line inside the shovel 100. The interface device 30D may include different types of communication interfaces in accordance with the type of communication line to be connected.

The interface device 30D functions as an external interface for reading and writing of information from and to a recording medium. The recording medium is, for example, a dedicated tool that is connected to a connector installed in the cabin 10 with an attachable/detachable cable. The recording medium may be a general-purpose recording medium such as an SD memory card or a universal serial bus (USB) memory. Thus, the program for achieving various functions of the controller 30 can be provided by, for example, a portable recording medium and installed in the auxiliary storage device 30A of the controller 30. The program may be downloaded from another computer outside the shovel 100 through the communication device 60 and then installed in the auxiliary storage device 30A.

Note that some of the functions of the controller 30 may be implemented by another controller device (processing circuitry). That is, the functions of the controller 30 may be achieved by multiple controllers mounted on the shovel 100 in a distributed manner.

The imaging device 40 acquires an image showing the state around the shovel 100. The imaging device 40 may also acquire (generate) three-dimensional data representing a location and an outer shape of an object around the shovel 100 within an imaging range (angle of view) (hereinafter, simply referred to as "three-dimensional data of an object"), based on the acquired image and data regarding a distance described later. Three-dimensional data of an object around the shovel 100 is, for example, data of coordinate information of a point group representing the surface of the object, distance image data, or the like.

For example, as illustrated in FIG. 1 and FIG. 2, the imaging device 40 includes a front camera 40F that captures images of the front of the upper swing body 3. The imaging device 40 may also include a rear camera 40B that captures images of the rear of the upper swing body 3, a left camera 40L that captures images of the left of the upper swing body 3, a right camera 40R that captures images of the right of the upper swing body 3, and the like. Thus, the imaging device 40 can capture images of the entire circumference around the shovel 100, that is, in a 360-degree range, in a top view of the shovel 100. The operator can visually recognize the surrounding image created based on the captured images taken by the left camera 40L, the right camera 40R, and the rear camera 40B and displayed on a display part of the output device 50 or the remote operation support device 300, and can ascertain the states of the left side, the right side, and the rear side of the upper swing body 3. By visually recognizing the surrounding image created based on the front camera 40F and displayed on the display part of the remote operation support device 300, the operator can also remotely operate the shovel 100 while ascertaining the movement of the attachment AT including the bucket 6.

The imaging device 40 is, for example, a monocular camera. The imaging device 40 may be a stereo camera, a time of flight (TOF) camera, or the like (hereinafter collectively referred to as a "3D camera") capable of acquiring distance (depth) information data in addition to a two-dimensional image.

Output data (for example, image data, three-dimensional data of an object around the shovel 100, or the like) of the imaging device 40 is input to the controller 30 via a one-to-one communication line or an in-vehicle network. Thus, for example, the controller 30 can monitor an object around the shovel 100 based on the output data of the imaging device 40. For example, the controller 30 can determine a surrounding environment of the shovel 100 based on the output data of the imaging device 40. For example, the controller 30 can also determine the attitude state of the attachment AT in the captured image based on the output data of the imaging device 40 (front camera). Furthermore, for example, the controller 30 can determine the attitude state of the body (upper swing body 3) of the shovel 100 with reference to the object around the shovel 100 based on the output data of the imaging device 40.

Instead of or in addition to the imaging device 40, a distance sensor may be provided in the upper swing body 3. The distance sensor is attached to, for example, the upper portion of the upper swing body 3, and acquires data on the distance and direction of a surrounding object with respect to the shovel 100. The distance sensor may acquire (generate) three-dimensional data (for example, data of coordinate information of a point group) of an object around the shovel 100 in a sensing range based on the acquired data. The distance sensor is, for example, a light detection and ranging (LIDAR) sensor. The distance sensor may be a millimeter wave radar, an ultrasonic sensor, an infrared sensor, or the like, for example.

Note that, depending on the use of the imaging device 40, some of the front camera 40F, the rear camera 40B, the left camera 40L, and the right camera 40R may be omitted. In a case where the remote operation of the shovel 100, the monitoring of the object around the shovel 100, or the like is not performed, the imaging device 40 may be omitted.

The sensor S1 is attached to the boom 4 and measures an attitude state of the boom 4. The sensor S1 then outputs measurement data including the attitude state of the boom 4. The attitude state of the boom 4 is, for example, an attitude angle (hereinafter, referred to as a "boom angle") around a rotation axis of a base end corresponding to a connection portion of the boom 4 with the upper swing body 3. The sensor S1 includes, for example, a rotary potentiometer, a rotary encoder, an acceleration sensor, an angular acceleration sensor, a six-axis sensor, an inertial measurement unit (IMU), and the like. Hereinafter, the same may be applied to the sensors S2 to S4. The sensor S1 may also include a cylinder sensor that detects the expansion/contraction position of the boom cylinder 7. Hereinafter, the same applies to the sensors S2 and S3. Output of the sensor S1 (measurement data including the attitude state of the boom 4) is transmitted to the controller 30. Thus, the controller 30 can ascertain the attitude state of the boom 4.

The sensor S2 is attached to the arm 5 and measures an attitude state of the arm 5. The sensor S2 then outputs measurement data including the attitude state of the arm 5. The attitude state of the arm 5 is, for example, an attitude angle (hereinafter, referred to as an "arm angle") around a rotation axis of a base end corresponding to a connection portion of the arm 5 with the boom 4. Output of the sensor S2 (measurement data including the attitude state of the arm 5) is transmitted to the controller 30. Thus, the controller 30 can ascertain the attitude state of the arm 5.

The sensor S3 is attached to the bucket 6 and measures an attitude state of the bucket 6. The sensor S3 then outputs measurement data including the attitude state of the bucket 6. The attitude state of the bucket 6 is, for example, an attitude angle (hereinafter, referred to as "bucket angle") around a rotation axis of a base end corresponding to a connection portion of the bucket 6 with the arm 5. Output of the sensor S3 (measurement data including the attitude state of the bucket 6) is transmitted to the controller 30. Thus, the controller 30 can ascertain the attitude state of the bucket 6.

The sensor S4 measures an attitude state of the body (for example, the upper swing body 3) of the shovel 100. The sensor S4 then outputs measurement data including the attitude state of the body of the shovel 100. The attitude state of the body of the shovel 100 is, for example, a state of inclination of the body with respect to a predetermined reference plane (for example, a horizontal plane). For example, the sensor S4 is attached to the upper swing body 3, and measures an inclination angle around two axes in the front-rear direction and the left-right direction of the shovel 100 (hereinafter, referred to as a "front-rear inclination angle" and a "left-right inclination angle", respectively). Output of the sensor S4 (measurement data including the attitude state of the body of the shovel 100) is transmitted to the controller 30. Thus, the controller 30 can ascertain the attitude state (inclined state) of the body (upper swing body 3).

The sensor S5 is attached to the upper swing body 3 and measures a swing state of the upper swing body 3. The sensor S5 then outputs measurement data including the swing state of the upper swing body 3. The sensor S5 measures, for example, a swing angular velocity and a swing angle of the upper swing body 3. The sensor S5 includes, for example, a gyro sensor, a resolver, a rotary encoder, and the like. Output of the sensor S5 (measurement data including the swing state of the upper swing body 3) is transmitted to the controller 30. Thus, the controller 30 can ascertain the swing state such as the swing angle of the upper swing body 3.

For example, the controller 30 can ascertain (estimate) the position of the tip (bucket 6) of the attachment AT based on the output of the sensors S1 to S5. Therefore, the controller 30 can control the movement of the shovel 100 by the automatic operation function while checking the position of the tip of the attachment AT.

Note that, in a case where the sensor S4 includes a gyro sensor, a six-axis sensor, an IMU, or the like capable of detecting an angular velocity about three axes, the swing state (for example, a swing angular velocity) of the upper swing body 3 may be detected based on a detection signal of the sensor S4. In such a case, the sensor S5 may be omitted.

The sensor S6 measures a position of the shovel 100. The sensor S6 may measure the position in world (global) coordinates or may measure the position in local coordinates at the work site. In the former case, the sensor S6 is, for example, a global navigation satellite system (GNSS) sensor. In the latter case, the sensor S6 is a transceiver capable of communicating with a device serving as a reference for positioning at a work site and outputting a signal corresponding to the position with respect to the reference. The output of the sensor S6 is transmitted to the controller 30.

Note that, in a case where the shovel 100 is not provided with an automatic operation function, the sensors S1 to S6 may be omitted. In such a case, a sensor capable of acquiring data on the acceleration of a piston rod of the boom cylinder 7 is separately provided. In a case where the sensor S1 is mounted on the shovel 100, another sensor (hereinafter referred to as an "acceleration sensor") capable of acquiring data on the acceleration of the piston rod of the boom cylinder 7 may be provided separately from the sensor S1. For example, a cylinder sensor capable of measuring the position of the piston of the boom cylinder 7 is provided as an acceleration sensor separately from the IMU as the sensor S1.

[First Example of Functional Configuration for Driving of Attachment]

Next, a first example of a functional configuration related to driving of the attachment AT in the shovel 100 will be described with reference to FIG. 5 to FIG. 7 in addition to FIG. 1 to FIG. 4.

Figure 5:
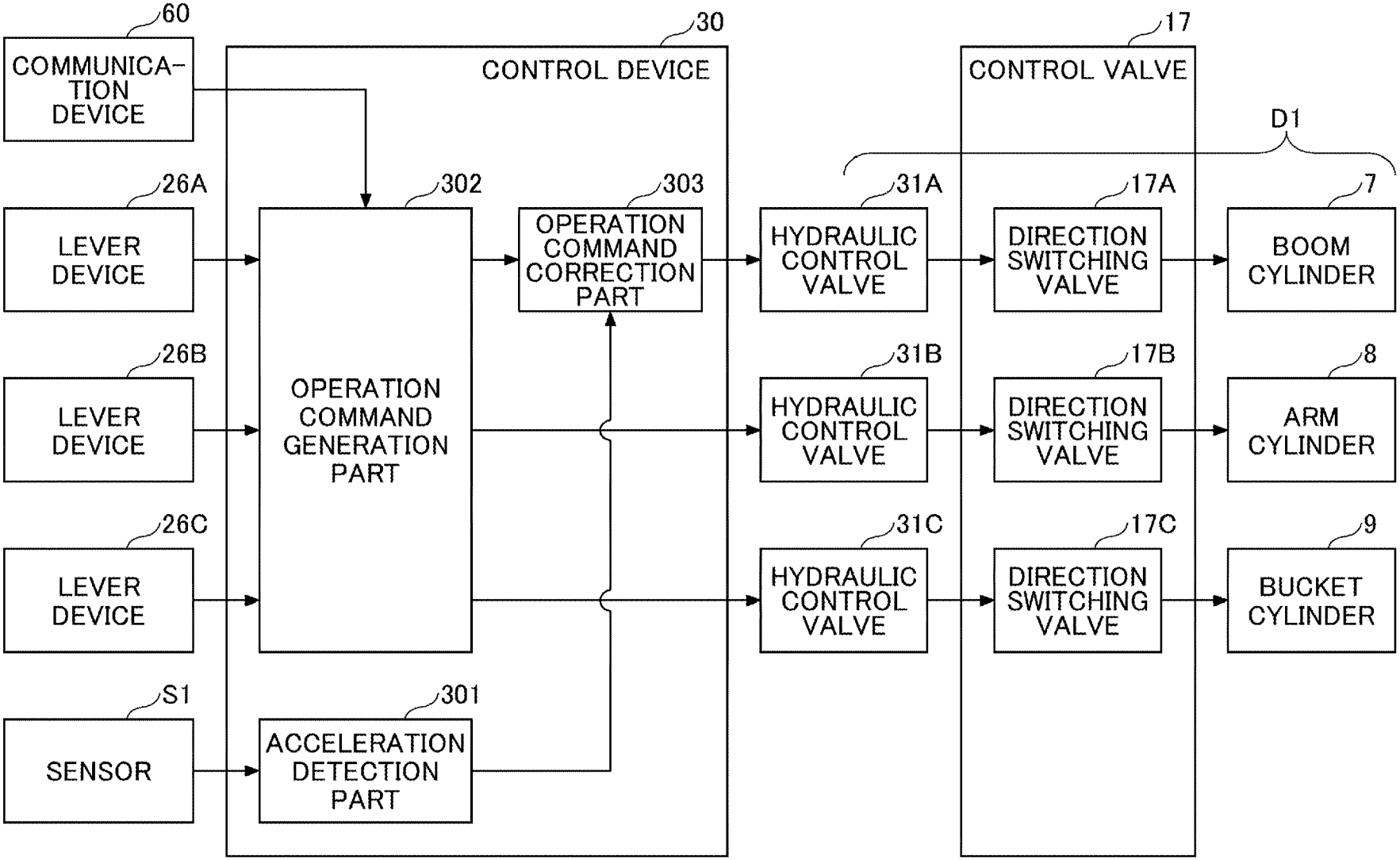
FIG. 5 is a functional block diagram illustrating a first example of a functional configuration related to driving of an attachment.

FIG. 5 is a functional block diagram illustrating a first example of a functional configuration related to driving of the attachment AT. FIG. 6 is a diagram for explaining a comparative example of a method of driving the boom 4 based on an operation command signal. FIG. 7 is a diagram for explaining an example of a method of driving the boom 4 based on an operation command signal.

In this example, all the driven elements of the shovel 100 are moved by the operation of the operator.

As illustrated in FIG. 5, the controller 30 includes an acceleration detection part 301, an operation command generation part 302, and an operation command correction part 303 as functional components related to the driving of the attachment AT.

The acceleration detection part 301 detects (calculates) the acceleration in the extension/contraction direction of the piston of the boom cylinder 7 based on the output of the sensor S1.

As described above, in a case where the acceleration sensor is provided instead of or in addition to the sensor S1, the acceleration detection part 301 detects (calculates) the acceleration of the piston of the boom cylinder 7 based on the output of the acceleration sensor. The acceleration detection part 301 may also detect (estimate) the acceleration of the piston of the boom cylinder 7 based on the operation state of the boom cylinder 7 at the operation device 26, that is, the operation state of a lever device 26A described later. In such a case, the above-described sensor S1 and acceleration sensor may be omitted.

The operation command generation part 302 generates operation command for hydraulic control valves 31A to 31C in accordance with operations related to the boom 4 (boom cylinder 7), the arm 5 (arm cylinder 8), and the bucket 6 (bucket cylinder 9) by the operator.

The hydraulic control valve 31A supplies a pilot pressure to the pilot port of the direction switching valve 17A. Specifically, as described above, two hydraulic control valves 31A are provided corresponding to the extension direction and the contraction direction of the boom cylinder 7.

The hydraulic control valve 31B outputs a pilot pressure to the pilot port of the direction switching valve 17B. Specifically, as described above, two hydraulic control valves 31B are provided corresponding to the extension direction and the contraction direction of the arm cylinder 8.

The hydraulic control valve 31C outputs a pilot pressure to the pilot port of the direction switching valve 17C. Specifically, as described above, two hydraulic control valves 31C are provided corresponding to the extension direction and the contraction direction of the bucket cylinder 9.

Specifically, a correspondence relationship is set in advance between the contents of the operation related to the boom 4 and the operation command to the hydraulic control valve 31A. Similarly, a correspondence relationship is set in advance between the contents of the operation related to the arm 5 and the operation command for the hydraulic control valve 31B. Similarly, a correspondence relationship is set in advance between the content of the operation related to the bucket 6 and the operation command for the hydraulic control valve 31C. Thus, the operation command generation part 302 can generate the operation command for the hydraulic control valves 31A to 31C from the contents of the operation related to the boom 4, the arm 5, and the bucket 6 based on, for example, a conversion formula, a conversion table, or the like corresponding to the correspondence relationship.

For example, the operation command generation part 302 generates an operation command for the hydraulic control valves 31A to 31C in accordance with operations performed on the lever devices 26A to 26C with respect to the boom 4, the arm 5, and the bucket 6.

The lever device 26A is used by the operator in the cabin 10 to perform an operation related to the boom 4 (boom cylinder 7).

The lever device 26B is used by the operator in the cabin 10 to perform an operation related to the arm 5 (arm cylinder 8).

The lever device 26C is used by the operator in the cabin 10 to perform an operation related to the bucket 6 (bucket cylinder 9).

The operation command generation part 302 generates an operation command for the hydraulic control valve 31 corresponding to the hydraulic actuator HA that drives the driven element.

For example, the operation command generation part 302 generates an operation command for the hydraulic control valve 31A based on the operation signal input from the lever device 26A. Similarly, the operation command generation part 302 generates an operation command for the hydraulic control valve 31B based on the operation signal input from the lever device 26B. Similarly, the operation command generation part 302 generates an operation command for the hydraulic control valve 31C based on the operation signal input from the lever device 26C.

The operation command generation part 302 may generate an operation command for the hydraulic control valves 31A to 31C in response to a remote operation signal received by the communication device 60.

Specifically, the operation command generation part 302 generates an operation command for the hydraulic control valve 31A based on the contents of the operation related to the boom 4 designated by the remote operation signal. Similarly, the operation command generation part 302 generates an operation command for the hydraulic control valve 31B based on the contents of the operation related to the arm 5 designated by the remote operation signal. Similarly, the operation command generation part 302 generates an operation command for the hydraulic control valve 31C based on the contents of the operation for the bucket 6 designated by the remote operation signal.

As illustrated in FIG. 5, the hydraulic control valve 31A, the direction switching valve 17A, and the boom cylinder 7 may be collectively referred to as a boom driving part D1.

The operation command correction part 303 corrects the operation command for the hydraulic control valve 31A generated by the operation command generation part 302 based on the detection result (acceleration of the piston of the boom cylinder 7) of the acceleration detection part 301, and outputs an operation command which has been corrected to the hydraulic control valve 31A. Hereinafter, any operation command which has been corrected is referred to as a "corrected operation command" for convenience. Thus, the hydraulic control valve 31A can supply the pilot pressure corresponding to the corrected operation command in which the acceleration state of the boom cylinder 7 is taken into consideration to the direction switching valve 17A. Accordingly, the controller 30 can suppress the vibration of the boom cylinder 7 caused by the operation input related to the boom 4 (boom cylinder 7).

Figure 6:
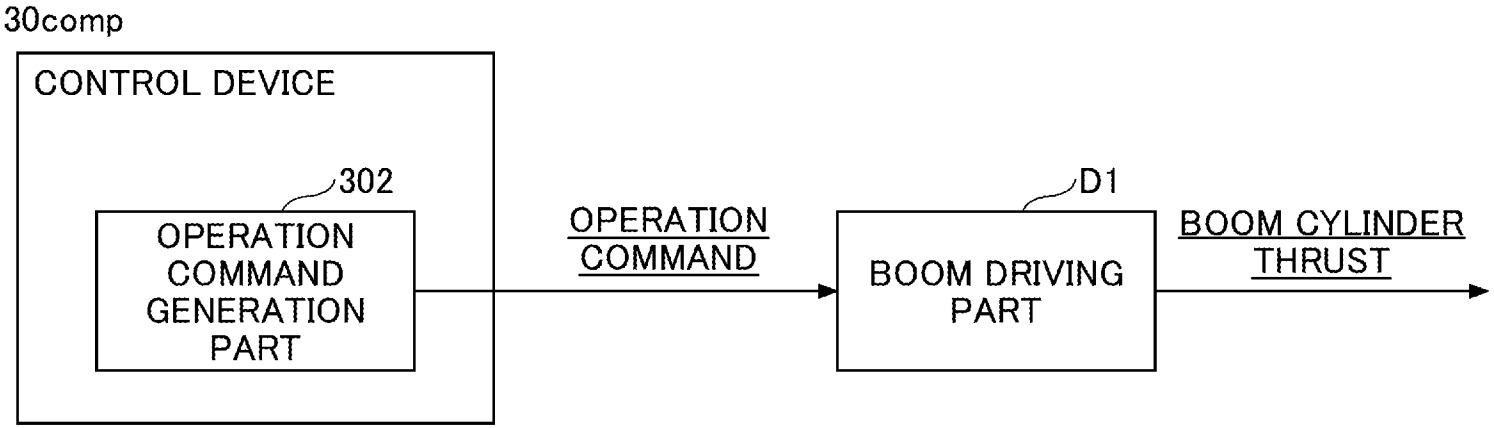
FIG. 6 is a diagram for explaining a comparative example of a method of driving a boom based on an operation command signal.

For example, as illustrated in FIG. 6, in the comparative example, an operation command generated by the operation command generation part 302 of a controller 30 comp is input to the hydraulic control valve 31A as it is. Therefore, the transfer function of the system from the input of the operation command to the output of the thrust of the boom cylinder 7 is determined by the characteristics of the boom driving part D1. As a result, depending on the contents of the operation related to the boom 4 by the operator, vibration may occur in the boom cylinder 7 according to the characteristics of the boom driving part D1. For example, during an operation corresponding to rapid acceleration or rapid deceleration of the boom 4, vibration may occur due to the hydraulic spring behavior of the oil column of the boom cylinder 7.

Figure 7:
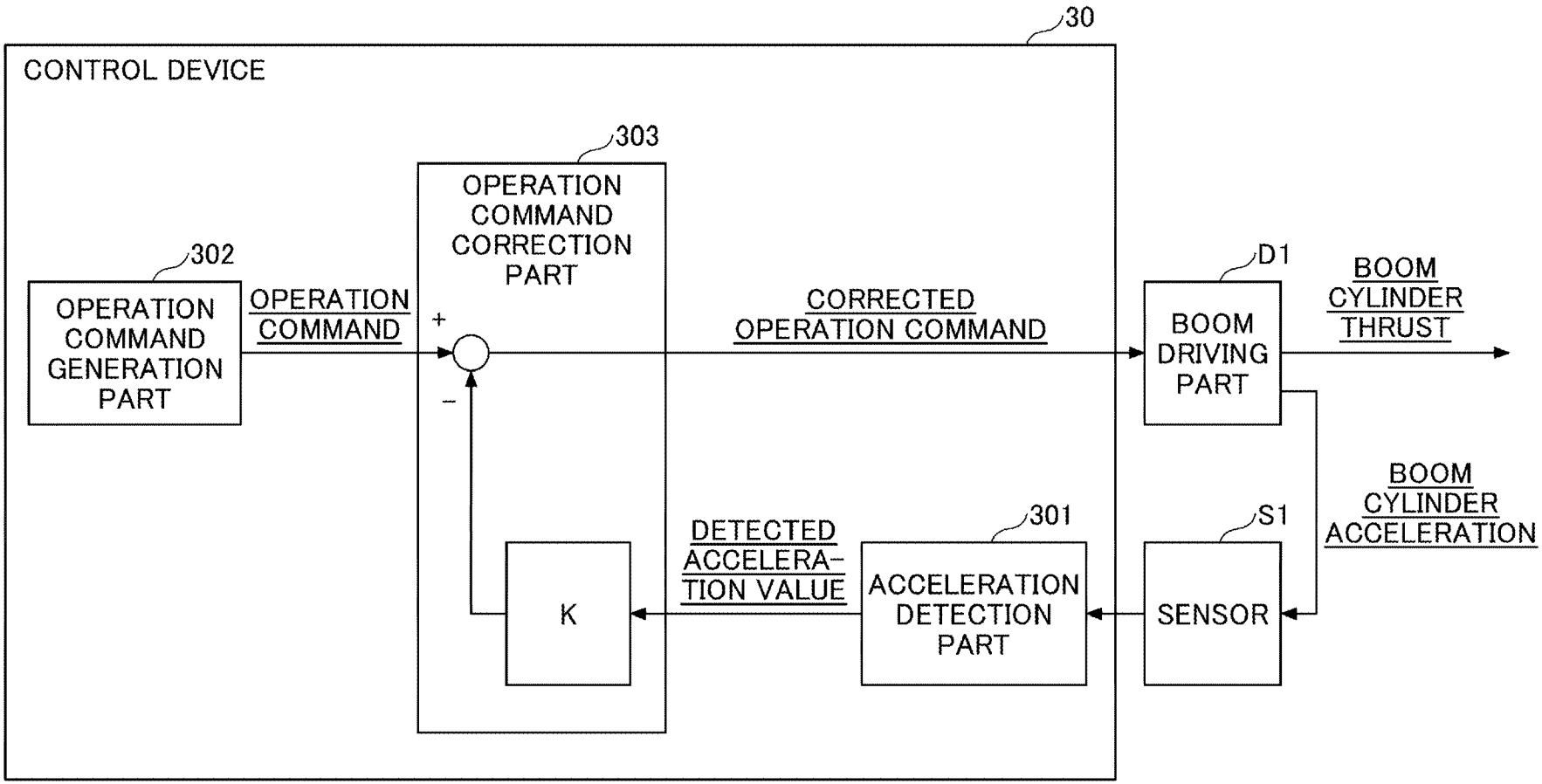
FIG. 7 is a diagram for explaining an example of a method of driving the boom based on the operation command signal.

For example, as illustrated in FIG. 7, the operation command correction part 303 generates a corrected operation command by using a value obtained by multiplying the detected acceleration value of the boom cylinder 7 by a gain K (>0) as a feedback to the operation command for the hydraulic control valve 31A. Thus, the controller 30 can adjust the transfer function of the system from the input of the operation command to the hydraulic control valve 31 to the output of the thrust of the boom cylinder 7.

For example, the boom driving part D1 includes a second order system between input and output (thrust of the boom cylinder), and the denominator of the transfer function is expressed by a second order polynomial. In such a case, in the system from the input of the operation command to the output of the thrust of the boom cylinder 7, the value obtained by multiplying the detected acceleration value by the gain K is fed back to the operation command, and thus the coefficient of a first order term (damping term) corresponding to a damping ratio of the second order system becomes larger than that in the comparative example. In other words, the controller 30 can adjust the transfer function to cause a pseudo-increase (i.e., simulate an increase) in a frictional force (specifically, a speed-dependent resistance force) of the boom cylinder 7. Therefore, the controller 30 can suppress the vibration of the thrust of the boom cylinder 7 caused by the operation input related to the boom cylinder 7. Accordingly, the controller 30 can suppress a decrease in the quality of work caused by the vibration of the boom cylinder 7, for example, and improve the quality of work using the attachment AT. Furthermore, the controller 30 can suppress discomfort that may be given to the operator by the vibration of the body (upper swing body 3) of the shovel 100, which is generated by the transmission of the vibration of the boom 4 caused by the vibration of the boom cylinder 7, for example. An operator who has relatively little experience in operating the shovel 100 has a strong tendency to perform an operation that causes vibration in the boom cylinder 7, compared to an operator who has relatively much experience. Therefore, the controller 30 can suitably support the operation of the shovel 100 by a relatively inexperienced operator.

The controller 30 may appropriately adjust the gain K to adjust the transfer function of the system such that the relationship between the operation input (operation command) regarding the boom cylinder 7 and the pseudo-frictional force (i.e., simulated frictional force) of the boom cylinder 7 approaches linearity. Thus, the controller 30 can improve the operability of the boom cylinder 7 by the operator.

Note that, the operation command correction part 303 may correct the operation command for the hydraulic control valve 31B or the hydraulic control valve 31C instead of or in addition to the operation command for the hydraulic control valve 31A to output the corrected operation command to the hydraulic control valve 31B or the hydraulic control valve 31C. In such a case, the acceleration detection part 301 detects the acceleration of the pistons of the arm cylinder 8 and the bucket cylinder 9 based on the output of the sensors S2 and S3, and the operation command correction part 303 corrects the operation commands for the hydraulic control valve 31B and the hydraulic control valve 31C based on the detection results of the acceleration detection part 301.

In such a way, in this example, the controller 30 can suppress, in accordance with the state of acceleration of the hydraulic cylinder that drives the attachment AT, the vibration of the hydraulic cylinder caused by the operation input related to the hydraulic cylinder by the operator.

[Specific Example of Vibration of Boom Cylinder Caused by Operation Input Related to Boom Cylinder]

Next, a specific example of vibration of the boom cylinder 7 caused by an operation input to the boom cylinder 7 will be described with reference to FIG. 8 to FIG. 10.

Figure 8:
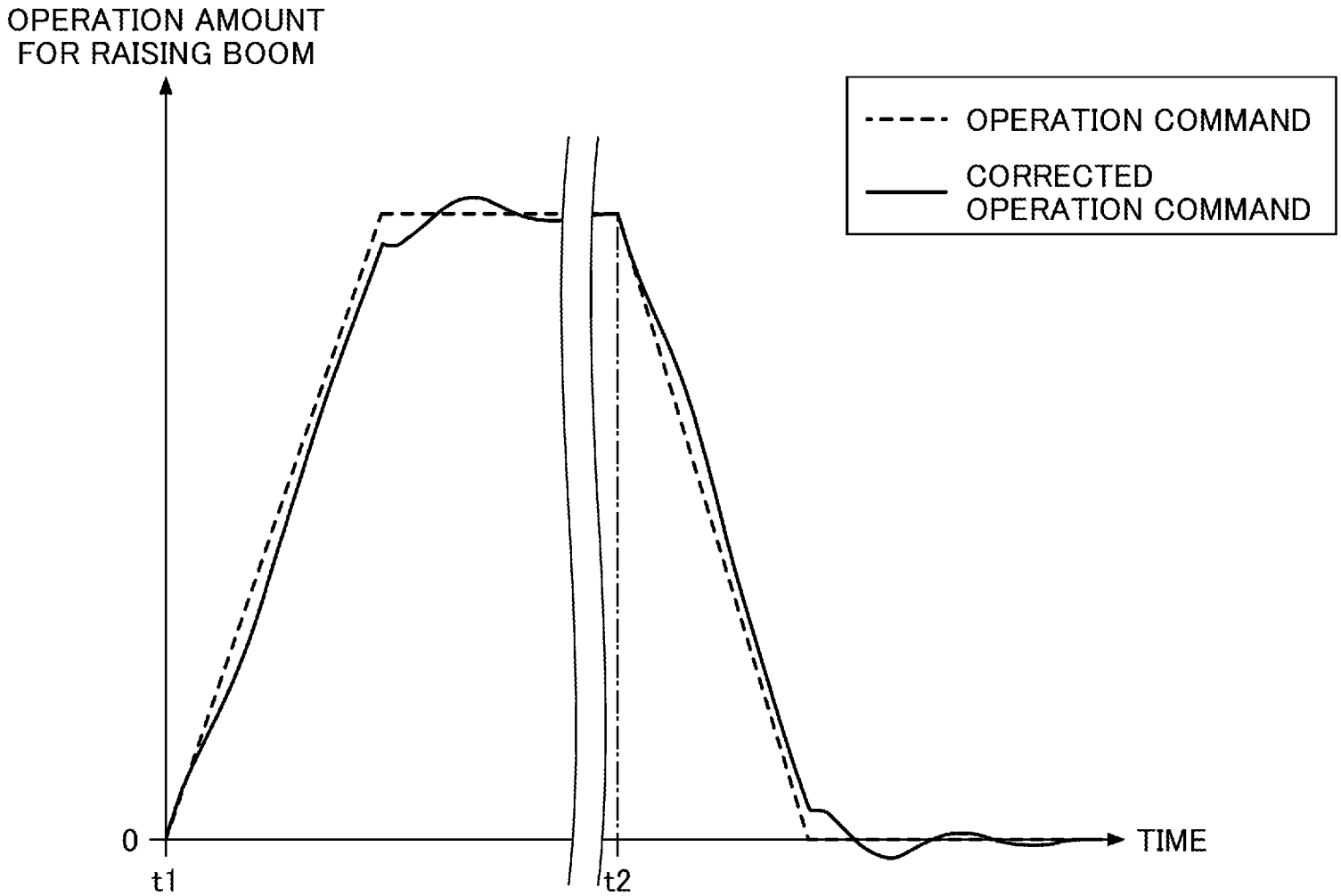
FIG. 8 is a diagram illustrating an example of time-series data of an operation command and a corrected operation command.

FIG. 8 is a diagram illustrating an example of time-series data of an operation command and a corrected operation command. FIG. 9 is a diagram illustrating an example of time-series data of a thrust of the boom cylinder 7. FIG. 10 is a diagram illustrating an example of time-series data of an inclination angle of the body of the shovel 100.

In this example, a case where the boom 4 is rapidly accelerated and decelerated (rapidly stopped) by the operation of raising the boom 4 from the stopped state will be described.

As illustrated in FIG. 8, according to the operation command for the hydraulic control valve 31A corresponding to the boom cylinder 7, the operation amount for raising the boom is rapidly increased substantially linearly from zero (0) with a time t1 as a starting point, a substantially constant state is maintained at a relatively large operation amount, and the operation amount is then sharply dropped substantially linearly from a time t2 as a starting point and returns to zero (0).

Figure 9:
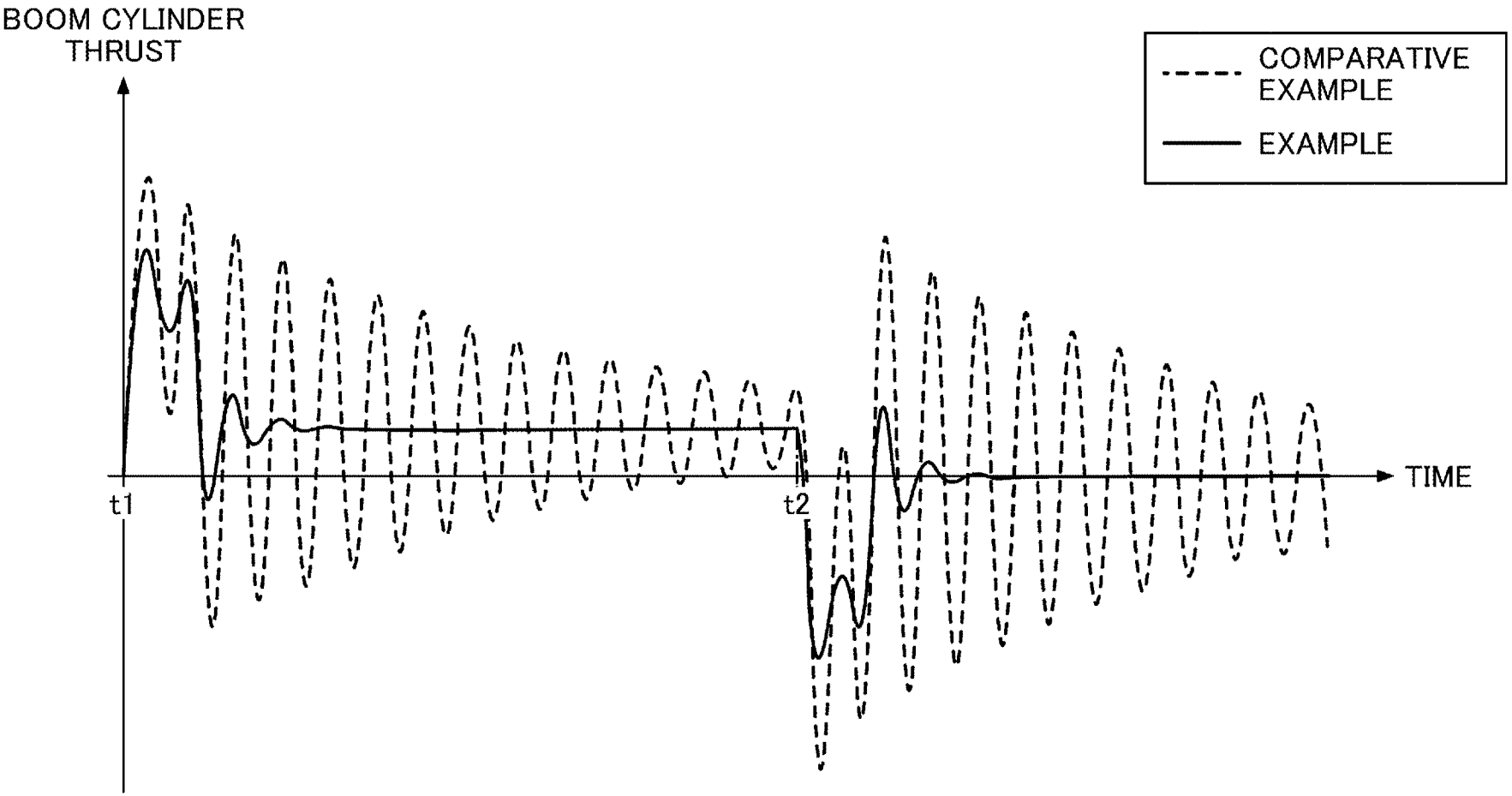
FIG. 9 is a diagram illustrating an example of time series data of a thrust of a boom cylinder.

As a result, as illustrated in FIG. 9, an overshoot in the thrust of the boom cylinder 7 occurs in response to a rapid increase in the operation amount from the time t1 according to the operation command, and vibration due to the oil column spring of the boom cylinder 7 occurs. Furthermore, in response to the rapid decrease of the operation amount from the time t2 according to the operation command, an undershoot in the thrust of the boom cylinder 7 occurs, and vibration due to the oil column spring of the boom cylinder 7 occurs.

As illustrated in FIG. 9, in the case of the comparative example (FIG. 6) in which the operation command is input to the boom driving part D1 as it is, the vibration due to the overshoot in the thrust of the boom cylinder 7 starting from the time t1 attenuates with the lapse of time but does not converge and continues until the time t2. In the case of the comparative example, before the first vibration starting from the time t1 converges, the vibration due to the undershoot in the thrust of the boom cylinder 7 starting from the time t2 occurs, and the vibration attenuates with the lapse of time but does not converge easily.

On the other hand, as illustrated in FIG. 8, according to the corrected operation command, the operation amount for raising the boom is corrected to be smaller than the operation amount corresponding to the operation command, in accordance with overshooting due to the rapid increase in the thrust (acceleration) of the boom cylinder 7 after time t1 (see FIG. 9) in the period of the rapid increase in the operation amount according to the operation command. Thus, as illustrated in FIG. 9, the controller 30 according to the example (FIG. 7) can greatly attenuate the vibration (overshooting) of the thrust of the boom cylinder 7, which starts at the time t1.

In the initial stage of the period in which the operation amount of the boom according to the operation command is relatively large and constant, the operation amount is corrected such that the vibration in the opposite phase to the vibration of the thrust (acceleration) of the boom cylinder 7 is generated according to the corrected operation command. Thus, as illustrated in FIG. 9, the controller 30 according to the example (FIG. 7) can converge the thrust of the boom cylinder 7 to a substantially constant state corresponding to the operation command at an early stage.

Furthermore, according to the corrected operation command, the operation amount for raising the boom is corrected to be larger than the operation amount corresponding to the operation command in accordance with the undershoot due to the rapid decrease in the thrust of the boom cylinder 7 after the time t2 (see FIG. 9) in the period of the rapid decrease in the operation amount according to the operation command. Thus, as illustrated in FIG. 9, the controller 30 according to the example (FIG. 7) can greatly attenuate the vibration (undershoot) of the thrust of the boom cylinder 7, which starts at the time t2.

In the initial stage of the period in which the operation amount of the boom according to the operation command is zero (0), the operation amount is corrected such that the vibration in the opposite phase to the vibration of the thrust (acceleration) of the boom cylinder 7 is generated according to the corrected operation command. Thus, as illustrated in FIG. 9, the controller 30 according to the example (FIG. 7) can converge the thrust of the boom cylinder 7 to a substantially zero (0) state corresponding to the operation command at an early stage.

Figure 10:
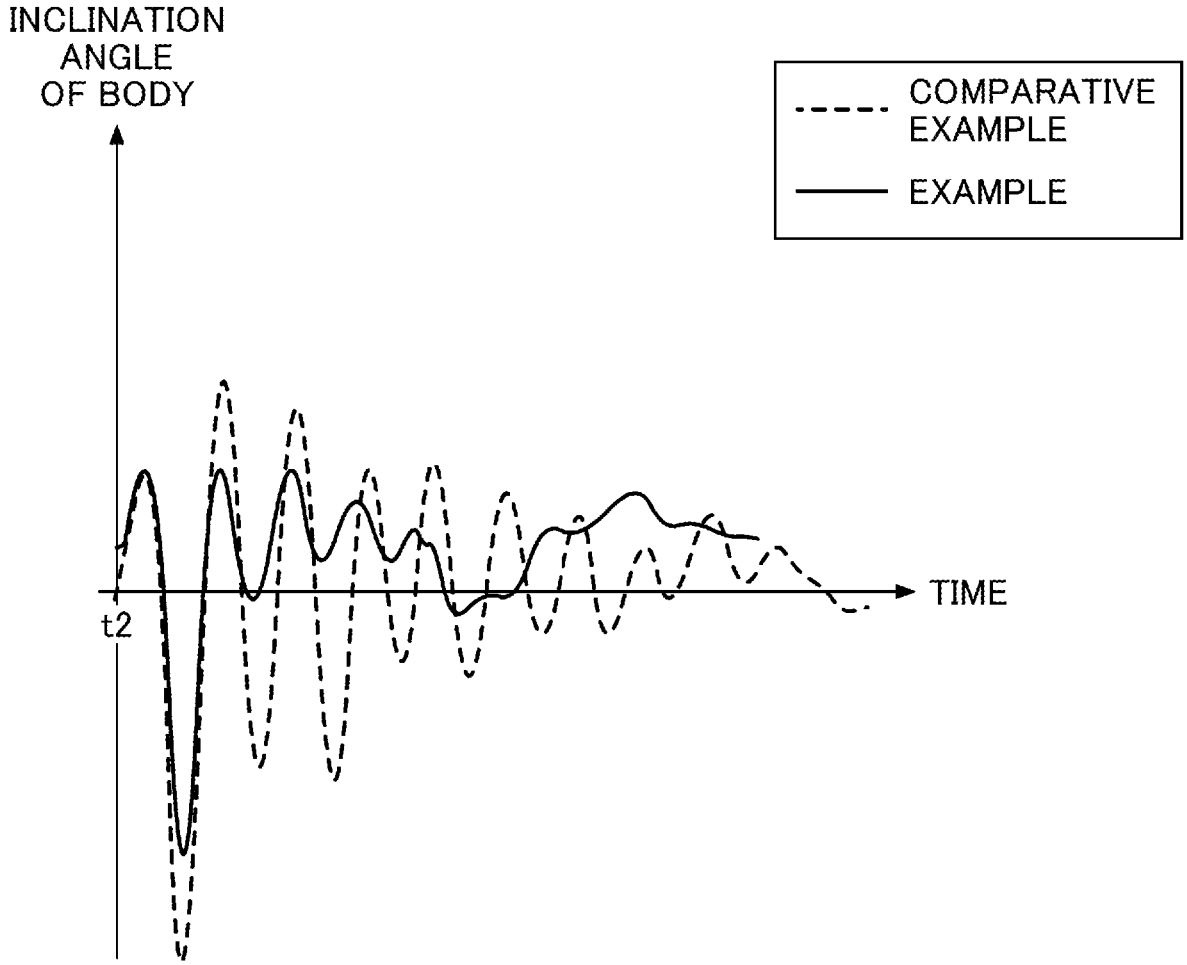
FIG. 10 is a diagram illustrating an example of time-series data of an inclination angle of the body of the shovel.

As illustrated in FIG. 10, the vibration of the boom cylinder 7 is transmitted as a reaction force from the boom 4 to the body (upper swing body 3) of the shovel 100, and as a result, the body of the shovel 100 vibrates.

In the case of the comparative example (FIG. 6), as described above, the vibration of the boom cylinder 7 does not converge easily, and the vibration of the body of the shovel 100 continues for a certain period. Therefore, the discomfort that may be given to the operator in the cabin 10 may increase.

On the other hand, in the example (FIG. 7), as described above, the vibration of the boom cylinder 7 can be converged to a state of substantially zero at an early stage according to the corrected operation command, and as a result, the vibration of the body of the shovel 100 can also be converged to the state of substantially zero at the early stage. Therefore, it is possible to suppress discomfort that may be given to the operator in the cabin 10.

[Second Example of Functional Configuration for Driving of Attachment]

Next, a second example of the functional configuration related to driving of the attachment AT in the shovel 100 will be described with reference to FIG. 11 in addition to FIG. 1 to FIG. 4.

Hereinafter, the same or corresponding components as those in the first example described above are denoted by the same reference numerals, and the description will be made focusing on the parts different from those in the first example described above, and the description of the same or corresponding parts as those in the first example described above may be simplified or omitted.

Figure 11:
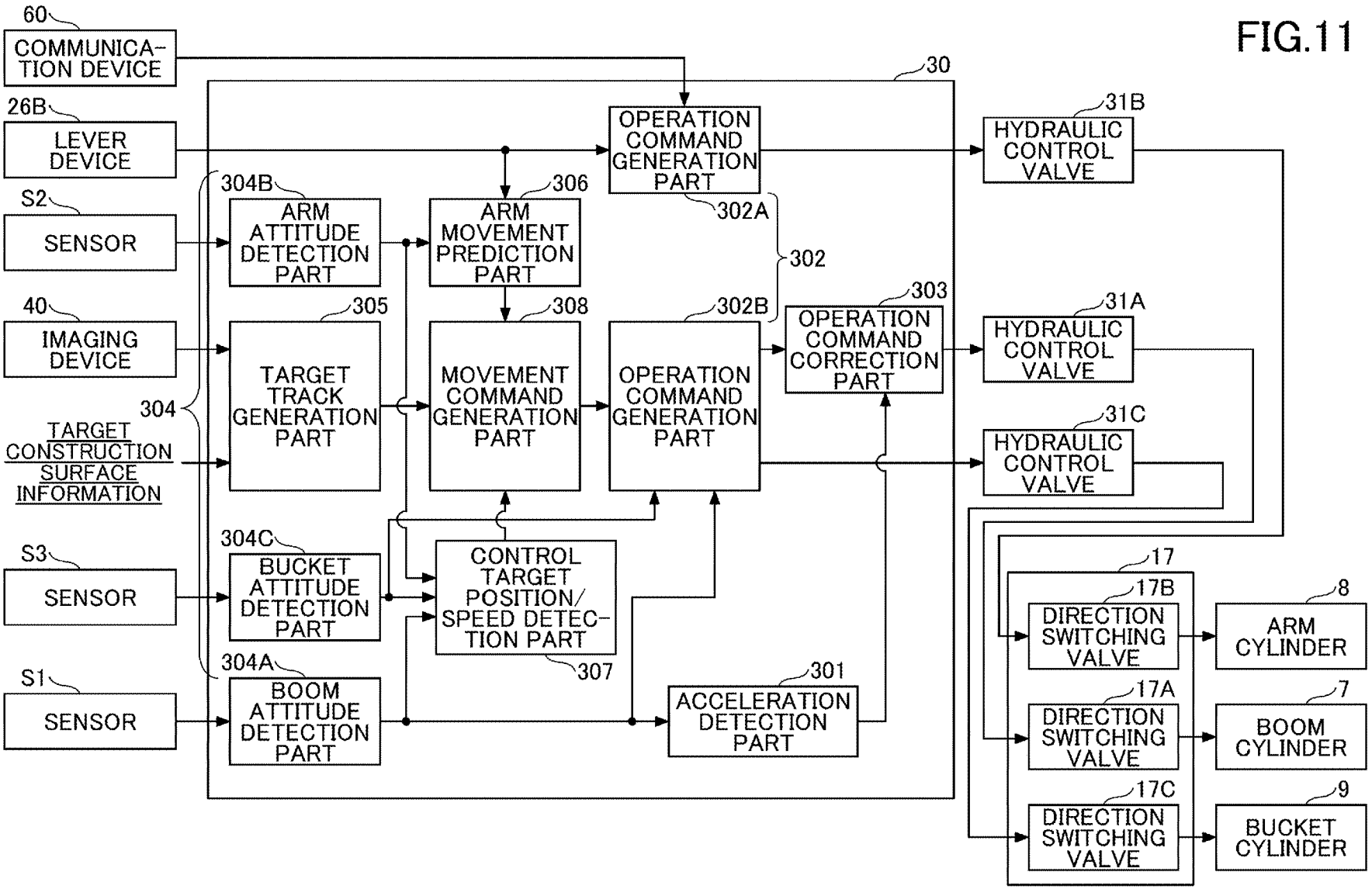
FIG. 11 is a functional block diagram illustrating a second example of the functional configuration related to driving of the attachment.

FIG. 11 is a functional block diagram illustrating the second example of the functional configuration related to driving of the attachment AT.

In this example, the attachment AT of the shovel 100 is moved by the semi-automatic operation function. Specifically, the shovel 100 performs a predetermined movement in response to an operation of the operator on any one of the boom 4, the arm 5, and the end attachment (bucket 6) so that the movement of one of the targets to be operated is interlocked with the movement of the other two targets to be operated. The predetermined movement is, for example, an excavating movement, a leveling movement, a rolling movement, or the like.

As illustrated in FIG. 11, the controller 30 includes, as the functional configuration related to the driving of the attachment AT, the acceleration detection part 301, the operation command generation part 302, and the operation command correction part 303 in the same manner as in the first example described above. The controller 30 also includes, as the functional configuration related to the driving of the attachment AT, an attitude detection part 304, a target track generation part 305, an arm movement prediction part 306, a control target position/speed detection part 307, and a movement command generation part 308, which are not included in the first example described above.

The attitude detection part 304 detects (calculates) the attitude of the attachment AT based on the output of the sensors S1 to S3. The attitude detection part 304 includes a boom attitude detection part 304A, an arm attitude detection part 304B, and a bucket attitude detection part 304C.

The boom attitude detection part 304A detects (calculates) the attitude angle (boom angle) of the boom 4 based on the output of the sensor S1. The boom attitude detection part 304A may detect a speed of change in the attitude angle of the boom 4 (a relative angular velocity of the boom 4 with respect to the upper swing body 3).

The arm attitude detection part 304B detects (calculates) the attitude angle (arm angle) of the arm 5 based on the output of the sensor S2. The arm attitude detection part 304B may detect a speed of change in the attitude angle of the arm 5 (a relative angular velocity of the arm 5 with respect to the boom 4).

The bucket attitude detection part 304C detects (calculates) the attitude angle (bucket angle) of the bucket 6 based on the output of the sensor S3. The bucket attitude detection part 304C may detect a speed of change in the attitude angle of the bucket 6 (a relative angular velocity of the bucket 6 with respect to the arm 5).

The target track generation part 305 generates a target track for a work part (bucket 6) of the attachment AT in a predetermined movement of the shovel 100. Specifically, the target track generation part 305 generates a target track for a control target point of the bucket 6. For example, when the shovel 100 performs an excavating movement or a leveling movement, the control target point is a point of the claw tip (claw edge) of the bucket 6. The point of the claw tip of the bucket 6 may be a point at the center of the claw tip in the width direction (the left-right direction) of the bucket 6, or may be a point at either one of the left end and right end of the claw tip. For example, in a case where a rolling movement of the shovel 100 is performed, the control target point is a predetermined point on the back surface of the bucket 6.

For example, the target track generation part 305 generates a target track for a control target point of the bucket 6 based on information on a target construction surface and output of the imaging device 40. The information on the target construction surface is input by the operator through the input device 52, for example. The information on the target construction surface may be input (received) from the outside of the shovel 100 through the communication device 60. Specifically, the target track generation part 305 may recognize the shape of the ground surface of the current work target based on the output of the imaging device 40. The target track generation part 305 may then generate the target track for the control target point of the bucket 6 based on the difference between the target construction surface and the shape of the ground surface of the current work target. More specifically, when the shortest distance between the target construction surface and the shape of the ground surface of the current work target exceeds a predetermined reference, the target track generation part 305 may generate the target track for the control target point (a point of the claw tip) of the bucket 6 for roughly excavating the sediment on the upper side of the target construction surface. On the other hand, when the shortest distance between the target construction surface and the ground surface of the current work target is equal to or less than the predetermined reference, the target track generation part 305 may generate the target track for the control target point of the bucket 6, such that the control target point of the bucket 6 passes on the target construction surface.

The arm movement prediction part 306 predicts a future movement of the arm 5 based on the contents of the operation related to the arm 5 (arm cylinder 8), the current arm angle, and the change rate of the arm angle. The contents of the operation related to the arm 5 (arm cylinder 8) are, for example, the output (operation signals) of the lever device 26B or remote operation signals received by the communication device 60. For example, the arm movement prediction part 306 predicts the attitude angle of the arm 5, the change speed of the attitude angle, and the like for each control cycle from a control cycle after the first cycle to a control cycle after N cycles (N refers to an integer of 2 or more). The control cycle corresponds to a cycle in which the controller 30 outputs an operation command or a corrected operation command to the hydraulic control valve 31. The prediction cycle of the arm movement prediction part 306 is longer than the control cycle related to the driving of the attachment AT by the controller 30, and corresponds to M control cycles (M=N+1), for example. Accordingly, a processing load of the controller 30 due to the processing of the arm movement prediction part 306 can be reduced.

The control target position/speed detection part 307 detects the current position and the moving speed of the control target point of the bucket 6 based on the output of the boom attitude detection part 304A, the arm attitude detection part 304B, and the bucket attitude detection part 304C.

The movement command generation part 308 generates a command (hereinafter, "movement command") indicating the movement of the attachment AT based on the target track for the control target point of the bucket 6, the prediction result of the arm movement prediction part 306, and the current position and speed of the control target point. Specifically, the movement command generation part 308 may generate movement commands for the boom 4 and the bucket 6 such that the control target point of the bucket 6 moves along the target track in accordance with the movement of the arm 5 corresponding to the prediction result of the arm movement prediction part 306. For example, the movement command generation part 308 generates the movement commands for the boom 4 and the bucket 6 for each control cycle from the current control cycle to the control cycle after N cycles. The generation cycle of the movement command generation part 308 corresponds to, for example, M control cycles, similarly to the prediction cycle of the arm movement prediction part 306. This can reduce the processing load of the controller 30 due to the processing of the movement command generation part 308. The movement commands for the boom 4 and the bucket 6 are, for example, command values of the respective attitude angles of the boom 4 and the bucket 6 and the change speeds thereof.

The operation command generation part 302 generates an operation command for the hydraulic control valves 31A to 31C, as in the first example described above. The operation command generation part 302 includes operation command generation parts 302A and 302B.

The operation command generation part 306A generates an operation command for the hydraulic control valve 31B based on the contents of the operation related to the arm 5 (arm cylinder 8) by the operator.

For example, the operation command generation part 302A generates an operation command for the hydraulic control valve 31B based on the operation signal of the lever device 26B.

The operation command generation part 302A may generate an operation command for the hydraulic control valve 31B in accordance with the contents of the operation related to the arm 5 (arm cylinder 8) designated by a remote operation signal received by the communication device 60.

The operation command generation part 302B generates an operation command for the hydraulic control valve 31A corresponding to the boom cylinder 7 based on the movement command for the boom 4 generated by the movement command generation part 308. Similarly, the operation command generation part 302B generates an operation command for the hydraulic control valve 31C corresponding to the bucket cylinder 9 based on the movement command for the bucket 6 generated by the movement command generation part 308.

The operation command correction part 303 corrects the operation command for the hydraulic control valve 31A generated by the operation command generation part 302B based on the detection result (acceleration of the piston of the boom cylinder 7) of the acceleration detection part 301, and outputs a corrected operation command to the hydraulic control valve 31A, as in the first example described above. Thus, the hydraulic control valve 31A can supply the pilot pressure corresponding to the corrected operation command in which the state of the acceleration of the boom cylinder 7 is taken into consideration to the direction switching valve 17A. Accordingly, the controller 30 can suppress the vibration of the boom cylinder 7 caused by the operation input related to the boom 4 (boom cylinder 7). Therefore, the controller 30 can improve the quality of the work by the semi-automatic operation function, for example.

Note that, as in the first example described above, the operation command correction part 303 may correct the operation command for the hydraulic control valve 31B or the hydraulic control valve 31C instead of or in addition to the operation command for the hydraulic control valve 31A, and output a corrected operation command to the hydraulic control valve 31B or the hydraulic control valve 31C.

In such a way, in this example, the controller 30 can suppress, in accordance with the state of acceleration of the hydraulic cylinder that drives the attachment AT, the vibration of the hydraulic cylinder caused by the operation command by the automatic operation function.

Effect

Next, the effect on the shovel according to this embodiment will be described.

In this embodiment, the shovel includes a lower traveling body, an upper swing body, an attachment, a hydraulic cylinder, and processing circuitry. The shovel is, for example, the shovel 100 described above. The lower traveling body is, for example, the lower traveling body 1 described above. The upper swing body is, for example, the upper swing body 3 described above. The attachment is, for example, the attachment AT described above. The hydraulic cylinders are, for example, the boom cylinder 7, the arm cylinder 8, and the bucket cylinder 9 described above. The processing circuitry is, for example, the controller 30 described above. Specifically, the upper swing body is swingably mounted on the lower traveling body. The attachment is attached to the upper swing body. The hydraulic cylinder drives the attachment. The processing circuitry controls, in accordance with the state of acceleration of the hydraulic cylinder, the movement of the hydraulic cylinder to suppress the vibration of the hydraulic cylinder caused by the operation input related to the hydraulic cylinder. The operation input related to the hydraulic cylinder is, for example, an operation input related to the hydraulic cylinder by the operator or an operation command corresponding to the automatic operation function.

Thus, the shovel can suppress, in accordance with the state of acceleration of the hydraulic cylinder, the vibration of the hydraulic cylinder caused by the operation input related to the hydraulic cylinder.

In this embodiment, the processing circuitry may control, in accordance with the state of acceleration of the hydraulic cylinder, the movement of the hydraulic cylinder to suppress the vibration of the hydraulic cylinder caused by the operation input related to the hydraulic cylinder, regardless of whether or not the vibration of the hydraulic cylinder occurs.

Thus, the shovel can suppress the vibration of the hydraulic cylinder caused by the operation input related to the hydraulic cylinder by considering the state of acceleration of the hydraulic cylinder, regardless of whether or not the vibration of the hydraulic cylinder occurs.

In this embodiment, the processing circuitry may control, in accordance with the state of acceleration of the hydraulic cylinder, the movement of the hydraulic cylinder to suppress overshooting or undershooting in the thrust of the hydraulic cylinder with respect to the operation input related to the hydraulic cylinder.

Thus, the shovel can suppress the vibration of the hydraulic cylinder caused by the operation input related to the hydraulic cylinder by suppressing the overshoot of the thrust of the hydraulic cylinder with respect to the operation input related to the hydraulic cylinder.

In this embodiment, the processing circuitry may adjust, in accordance with the state of acceleration of the hydraulic cylinder, the transfer function from the operation input to the occurrence of the thrust of the hydraulic cylinder to cause a pseudo increase in a frictional force of the hydraulic cylinder depending on the speed of the hydraulic cylinder.

Thus, the shovel can suppress the vibration of the hydraulic cylinder caused by the operation input related to the hydraulic cylinder by causing a pseudo-increase in the frictional force of the hydraulic cylinder.

In this embodiment, the processing circuitry may adjust, in accordance with the state of acceleration of the hydraulic cylinder, the transfer function from the operation input to the occurrence of the thrust of the hydraulic cylinder such that the change in the frictional force of the hydraulic cylinder with respect to the operation input seemingly approaches linearity.

Thus, the shovel can improve the operability of the hydraulic cylinder.

In this embodiment, the processing circuitry may control the movement of the hydraulic cylinder by using the state of acceleration of the hydraulic cylinder as a feedback to the operation input related to the hydraulic cylinder.

Thus, the shovel can suppress, in accordance with the state of acceleration of the hydraulic cylinder, the vibration of the hydraulic cylinder caused by the operation input related to the hydraulic cylinder.

In this embodiment, the operation input related to the hydraulic cylinder may be an input of an operation command for automatically operating the hydraulic cylinder.

Accordingly, the shovel can suppress the vibration of the hydraulic cylinder caused by the input of the operation command when the hydraulic cylinder is automatically operated. Therefore, the quality of the work by the automatic operation of the shovel can be improved.

In this embodiment, the attachment may include a boom, an arm, and an end attachment. The hydraulic cylinder may be a boom cylinder that drives a boom. The boom cylinder is, for example, the boom cylinder 7 described above.

Accordingly, the shovel can suppress the vibration of the boom cylinder caused by the operation input related to the boom cylinder. Therefore, the shovel can suppress the vibration of the body (upper swing body) due to a reaction force of the vibration of the boom caused by the vibration of the boom cylinder to suppress the discomfort that may be given to the operator in the cabin mounted on the shovel.

Although the embodiments have been described in detail, the present disclosure is not limited to the above-described embodiments and the like. Various changes, modifications, substitutions, additions, deletions, and combinations may be made without departing from the scope of the present disclosure.

What is claimed is:

1. A shovel comprising:

a lower traveling body;

an upper swing body swingably mounted on the lower traveling body;

an attachment attached to the upper swing body; a hydraulic cylinder configured to drive the attachment;

a main pump configured to supply hydraulic oil to the hydraulic cylinder;

a direction switching valve configured to control a flow rate and a flow direction of the hydraulic oil supplied from the main pump to the hydraulic cylinder;

a pilot pump configured to supply a pilot pressure to the direction switching valve;

a hydraulic control valve provided in a pilot line between the pilot pump and the direction switching valve; and processing circuitry configured to control, in accordance with a state of acceleration of the hydraulic cylinder, movement of the hydraulic cylinder to suppress vibration of the hydraulic cylinder caused by an operation input related to the hydraulic cylinder by detecting acceleration of the hydraulic cylinder, correcting an operation command for the hydraulic control valve based on a value obtained by multiplying the detected acceleration by a gain, the operation command being generated based on an operation input related to the hydraulic cylinder, and outputting the corrected operation command to the hydraulic control valve, wherein the processing circuitry is configured to correct the operation command such that:

(i) an operation amount according to the corrected operation command is smaller than an operation amount corresponding to the operation command, in a period of an increase in the operation amount corresponding to the operation command and (ii) the operation amount according to the corrected operation command is larger than the operation amount corresponding to the operation command, in a period of a decrease in the operation amount corresponding to the operation command.

2. The shovel as claimed in claim 1, wherein the processing circuitry is configured to control, in accordance with a state of the acceleration of the hydraulic cylinder, the movement of the hydraulic cylinder to suppress vibration of the hydraulic cylinder due to the operation input related to the hydraulic cylinder, regardless of whether or not the vibration of the hydraulic cylinder occurs.

3. The shovel as claimed in claim 1, wherein the processing circuitry is configured to control, in accordance with a state of the acceleration of the hydraulic cylinder, the movement of the hydraulic cylinder to suppress an overshoot or undershoot in thrust of the hydraulic cylinder with respect to the operation input related to the hydraulic cylinder.

4. The shovel as claimed in claim 1, wherein the processing circuitry is configured to adjust, in accordance with a state of the acceleration of the hydraulic cylinder, a transfer function from the operation input to thrust of the hydraulic cylinder to simulate an increase in a frictional force of the hydraulic cylinder depending on the acceleration of the hydraulic cylinder.

5. The shovel as claimed in claim 4, wherein the processing circuitry is configured to adjust, in accordance with the state of the acceleration of the hydraulic cylinder, the transfer function from the operation input to the thrust of the hydraulic cylinder such that a relationship between the operation input and the simulated frictional force approaches linearity.

6. The shovel as claimed in claim 1, wherein the processing circuitry is configured to control the movement of the hydraulic cylinder by using a state of the acceleration of the hydraulic cylinder as feedback to the operation input related to the hydraulic cylinder.

7. The shovel as claimed in claim 1, wherein the operation input is an input of an operation command for automatically operating the hydraulic cylinder.

8. The shovel as claimed in claim 1, wherein the attachment includes a boom, an arm, and an end attachment, and the hydraulic cylinder is a boom cylinder configured to drive the boom.

9. The shovel as claimed in claim 1, wherein the processing circuitry is further configured to correct the operation command such that (iii) a vibration opposite in phase to a vibration of thrust of the hydraulic cylinder is generated in an initial stage of a period in which the operation amount according to the operation command is constant between the period of the increase and the period of the decrease.

10. The shovel as claimed in claim 1, wherein the processing circuitry is further configured to correct the operation command such that (iii) a vibration opposite in phase to a vibration of thrust of the hydraulic cylinder is generated in (a) an initial stage of a period in which the operation amount according to the operation command is constant between the period of the increase and the period of the decrease and (b) an initial stage of a period in which the operation amount according to the operation command is zero after the period of the decrease.

* * * * *